US012246246B2

(12) United States Patent
Eckart

(10) Patent No.: US 12,246,246 B2
(45) Date of Patent: Mar. 11, 2025

(54) HEEL UNIT FOR A GLIDING BOARD BINDING HAVING MZ RELEASE VIA A CAM BODY

(71) Applicant: Salewa Sport AG, Denges (CH)

(72) Inventor: Uwe Eckart, Aschheim (DE)

(73) Assignee: Salewa Sport AG, Denges (CH)

( * ) Notice: Subject to any disclaimer, the term of this patent is extended or adjusted under 35 U.S.C. 154(b) by 21 days.

(21) Appl. No.: 18/122,200

(22) Filed: Mar. 16, 2023

(65) Prior Publication Data

US 2023/0293968 A1 Sep. 21, 2023

(30) Foreign Application Priority Data

Mar. 17, 2022 (DE) ..... 10 2022 106 276.7

(51) Int. Cl.
*A63C 9/12* (2012.01)

(52) U.S. Cl.
CPC ..... *A63C 9/12* (2013.01)

(58) Field of Classification Search
CPC ..... A63C 9/12; A63C 9/0843; A63C 9/0845; A63C 9/0855; A63C 9/08564; A63C 9/086; A63C 9/0807
See application file for complete search history.

(56) References Cited

U.S. PATENT DOCUMENTS 4,079,962 A * 3/1978 Frechin ..... A63C 9/086 280/613
11,369,858 B2 * 6/2022 Dulcamara ..... A63C 9/086

FOREIGN PATENT DOCUMENTS

DE 3630552 A1 * 3/1988
DE 102005048995 A1 * 3/2007 ..... A63C 9/08521
DE 102011078834 A1 * 1/2013 ..... A63C 9/0807
DE 102011079210 A1 1/2013
EP 0199098 A2 10/1986
EP 0199098 A3 4/1987
(Continued)

OTHER PUBLICATIONS

European Application No. 23161829.9, "Extended European Search Report", No English translation available, Sep. 27, 2023, 9 pages.
(Continued)

*Primary Examiner* — James A Shriver, II
*Assistant Examiner* — Michael T. Walsh
(74) *Attorney, Agent, or Firm* — Kilpatrick Townsend & Stockton LLP

(57) ABSTRACT

A heel unit including a base comprising a fastening arrangement for fastening to a gliding board, a binding body, and coupling means arranged on the binding body. The coupling means engage with a heel portion of a gliding board boot in a downhill position of the gliding board binding to securely hold the gliding board boot on the gliding board binding. The coupling means protrude in a longitudinal direction from the binding body in the downhill position. The heel unit includes an Mz release mechanism to preload the coupling means into the downhill position so that, in the downhill position, the coupling means are freed from engagement with the gliding board boot upon action of a force exceeding a predetermined release force, and so that the coupling means move from the downhill position into a release position via rotational movement of the binding body about the release axis of rotation.

17 Claims, 13 Drawing Sheets

(56) References Cited

FOREIGN PATENT DOCUMENTS

Figure 1:
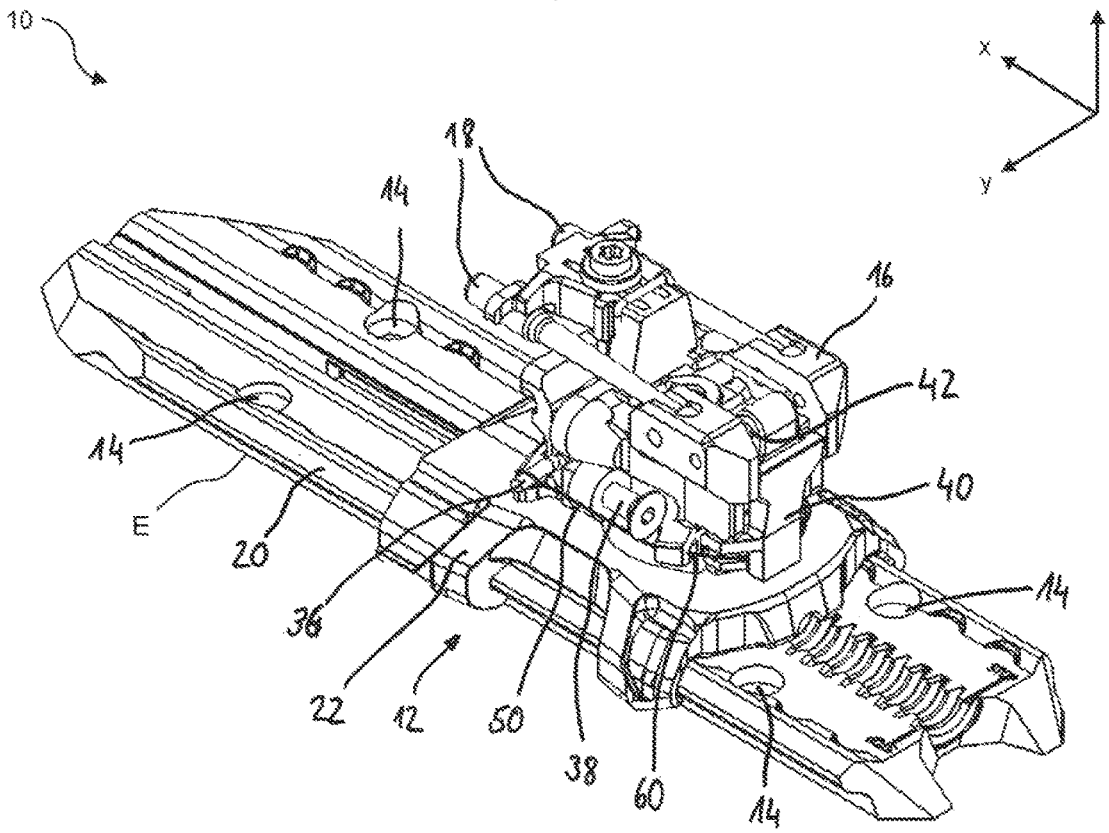

| | | | | |
|---|---|---|---|---|
| EP | 0199098 B1 * | 2/1990 | | |
| EP | 2545966 A2 | 1/2013 | | |
| EP | 2384794 B1 * | 9/2014 | ..... | A63C 9/0807 |
| EP | 4180096 A1 * | 5/2023 | ..... | A63C 7/104 |
| FR | 2957264 A1 | 9/2011 | | |
| FR | 2957264 B1 * | 5/2019 | ..... | A63C 9/0807 |
| FR | 3098412 A3 * | 1/2021 | ..... | A63C 9/0807 |

OTHER PUBLICATIONS

German Application No. 102022106276.7, Search Report mailed Dec. 16, 2022, 6 pages.

* cited by examiner

A-A

B-B

C-C

D-D

E-E

F-F

G-G

HEEL UNIT FOR A GLIDING BOARD BINDING HAVING MZ RELEASE VIA A CAM BODY

CROSS REFERENCE TO RELATED APPLICATION

This application claims priority to German Patent Application No. 10 2022 106 276.7, filed in Germany on Mar. 17, 2022, the entire contents of which are hereby incorporated herein by reference.

The present invention relates to a heel unit for a gliding board binding, in particular for a touring binding, comprising a base having a fastening arrangement for fastening to a gliding board, a binding body which is rotatable relative to the base about a release axis of rotation that extends orthogonally to a gliding board plane, coupling means which are arranged on the binding body and are designed to be in engagement with a heel portion of a gliding board boot in a downhill position of the gliding board binding, in order to securely hold the gliding board boot on the gliding board binding, the coupling means protruding from the binding body, in the downhill position, in a gliding board longitudinal direction, in particular forwards in a direction of travel, and an Mz release mechanism which is designed to preload the coupling means into the downhill position in such a way that, in the downhill position, they are freed from the engagement with the gliding board boot upon action of a force exceeding a predetermined release force, and move out of the downhill position and into a release position by means of a rotational movement of the binding body about the release axis of rotation, the Mz release mechanism comprising a spring arrangement having a spring means, which determines the predetermined release force, and the Mz release mechanism comprising a cam body which is arranged on the binding body and is designed, in the downhill position, to enter link engagement with a mating contour of a cam surface provided on the base.

The heel units addressed by the present disclosure are in particular heel units for touring bindings, which are to be mounted on skis or touring skis. However, splitboards (snowboards which can be divided in the longitudinal direction and the half of which can be used as touring skis) or the like are also possible as a gliding board on which a heel unit according to the present invention is to be fastened, such that the invention also relates to heel units for bindings of such gliding boards, even if reference is made in the following, without restricting the subject matter of the invention, mainly to touring bindings.

Heel units of this kind are known for example from DE 10 2011 079 210 A1 or also EP 0 199 098 A3 and typically comprise an axial body, fixed to the base, in the form of a stud or journal which is arranged substantially orthogonally with respect to the gliding board plane, about which the binding body can rotate. Typically, in this case, a spring means in the form of a compression spring is provided, which is supported at one spring end portion on a link surface provided on said axial body, and at the other spring end portion on a portion of the binding body, in order to preload the heel unit into the downhill position. As a result of this configuration, in the event of a user of the heel unit falling, in the case of forces occurring at the coupling means which exceed a predetermined threshold value, a rotation of the binding body about the axial body, counter to the spring force of the compression spring, provides an Mz safety release.

Mz and My are release torques of gliding board bindings. My is the torque for a release when a torque acts about a gliding board transverse axis (Y-axis), if said torque exceeds an My release torque. Mz is the torque for a release in the case of a rotation of the gliding board boot in the gliding board binding, and My is the torque in the case of a forwards inclination, for example falling forwards. Accordingly, an Mz safety release ensures that the gliding board boot is freed from the gliding board binding when a torque acts about a Z-axis, if said torque exceeds an Mz release torque. The Z-axis extends in parallel with the release axis of rotation orthogonal to the gliding board plane. The Mz release mechanism is intended for providing an Mz safety release of this kind in as defined a manner as possible.

However, an arrangement, as in the case of the known heel units, of the compression spring and axial body one behind the other along the gliding board longitudinal direction is associated with a relatively large space requirement in the gliding board longitudinal direction, and the Mz release mechanism of the known heel units takes up a relatively large amount of installation space in the gliding board longitudinal direction. In addition to an increased space requirement, this can also be problematic for example with respect to a higher weight of the heel unit due to the longer design.

Against this background, the object of the present invention was that of providing a heel unit for a gliding board binding, in particular for a touring binding, having a compact design in particular in the gliding board longitudinal direction.

According to the invention this object is achieved, according to a first aspect of the invention, by a heel unit for a gliding board binding, in particular for a touring binding, comprising a base having a fastening arrangement for fastening to a gliding board, a binding body which is rotatable relative to the base about a release axis of rotation that extends orthogonally to a gliding board plane, coupling means which are arranged on the binding body and are designed to be in engagement with a heel portion of a gliding board boot in a downhill position of the gliding board binding, in order to securely hold the gliding board boot on the gliding board binding, the coupling means protruding from the binding body, in the downhill position, in a gliding board longitudinal direction, in particular forwards in a direction of travel, and an Mz release mechanism which is designed to preload the coupling means into the downhill position in such a way that, in the downhill position, they are freed from the engagement with the gliding board boot upon action of a force exceeding a predetermined release force, and move out of the downhill position and into a release position by means of a rotational movement of the binding body about the release axis of rotation, the Mz release mechanism comprising a spring arrangement having a spring means, which determines the predetermined release force, and the Mz release mechanism comprising a cam body which is arranged on the binding body and is designed, in the downhill position, to enter link engagement with a mating contour of a cam surface provided on the base, the spring arrangement being designed to exert a tractive force on the cam body, in order to draw it into link engagement with the mating contour of the cam surface, as a result of which the coupling means are preloaded into the downhill position.

An important aspect of this solution according to the invention is therefore that of preloading the coupling means into the downhill position by exerting a tractive force on the cam body. A configuration of this kind allows for a space-saving design of the Mz release mechanism, in particular in the gliding board longitudinal direction.

In a preferred embodiment of the present invention, the spring arrangement can comprise a cable element which is designed to transfer the tractive force onto the cam body. A cable element can be deflected at virtually all positions of the heel unit, as a result of which a plurality of possible arrangements for the elements of the spring arrangement are possible. In particular, the spring means can be arranged virtually at any point, and the spring force of the spring means can be transferred expediently by the correspondingly guided or deflected cable element and exerted at the required point. This configuration allows for a plurality of different possible designs and, in the case of a skillful structural arrangement of the spring means and of the cable element, a significant amount of installation space can be saved. In other words, the heel unit can be designed in a particularly compact manner, in particular in the gliding board longitudinal direction.

If the spring arrangement comprises a cable element, a first end portion of the cable element can preferably be fastened to the spring means. This can preferably be achieved by a loop formed on the cable end, or in a similar manner. Alternatively, other suitable connections between the cable element and spring means are conceivable, but preferably a direct connection is provided in order to be able to achieve a direct force transmission without significant frictional losses. Alternatively, the first end portion of the cable element can also be fastened to the spring means via a connection intermediate element.

Furthermore, a second end portion of the cable element can be fixed to the binding body. In particular, it is intended for such fixing of the cable element on the binding body to be achieved via a seal or the like arranged on the end portion of the cable element, the cable element first being guided through a through-hole or another recess in the binding body. Alternatively, any other thickening can also be provided on the end portion of the cable element. In turn, a connection via a loop formed on the cable end, which is suspended on a protrusion on the binding body, or another suitable connection—either directly or via a connection intermediate element—is also conceivable. Since the second end portion of the cable element is fixed to the binding body, the cable element can transfer the spring force of the spring means to the cam body, in order to provide the release force for the Mz release mechanism, as a result of which again a wide range of design possibilities for the spring arrangement are possible, a compact structure of the heel unit is achieved, and nonetheless a relatively high release force can be provided.

Furthermore, the binding body can comprise at least one guide portion for the cable element. Guide portions on the binding body make it possible for the cable element to be guided and deflected around the binding body for example. If the binding body itself functions as the deflection element, the cable element remains tightly against said body, and a compact structure can again be achieved. Furthermore, the at least one guide portion for the cable element on the binding body makes it possible for the position of the cable element to be fixed relatively exactly and deflected such that the cable element does not enter a movement range of other movable elements of the heel unit with which the cable element is not intended to interact and the movement of which the cable element should not impede. Thus, possible malfunctions of the heel unit can be particularly easily prevented by the at least one guide portion for the cable element, provided on the binding body.

In a further preferred embodiment of the present invention, the spring means can be a torsion spring. Torsion springs are used to generate a torque or to accumulate rotation energy in a structure. Within the meaning of the present invention, further designations such as leg spring or coil spring are relevant for the "torsion spring" type of spring. These terms can equally be used instead of "torsion spring". An advantage of using a torsion spring as the spring means for the spring arrangement is for example that torsion springs can be designed so as to be relatively compact in the direction of a central axis of their windings, and the spring arrangement thus requires less installation space, in particular in the gliding board longitudinal direction, as a result of which the entire arrangement of the heel unit can be designed so as to be more compact.

If the spring arrangement comprises a cable element, and if the spring means is a torsion spring, then a first spring leg of the torsion spring can be supported on a portion of the binding body and/or a second spring leg of the torsion spring can be supported on a portion of the cable element, in particular on a first end portion of the cable element. Supporting the spring legs of the torsion spring on the binding body and on the cable element, respectively, allows a direct force transmission between the spring arrangement and the binding body, on which the coupling means are arranged. Said force transmission can take place, in an advantageous and space-saving manner, by means of the flexible cable element, which can be deflected at suitable points in order to obtain a particularly compact overall arrangement.

In a further advantageous embodiment of the present invention, the spring means can be a tension spring. Although a tension spring is less compact, along the central axis of its spring windings, than a torsion spring for example, it offers particularly simple design options and can be arranged outside of a central axis in the gliding board longitudinal direction of the heel unit, as a result of which an arrangement can be arranged, instead of behind or in front of an axial body of the base, beside said body or beside the binding body, in a gliding board transverse direction (y-direction), as a result of which, in turn, the length of the heel unit in the gliding board longitudinal direction (x-direction) can be reduced.

If the spring means is a tension spring, a first spring end of the tension spring can be associated with the binding body, and/or a second spring end of the tension spring can be associated with the cam body. In this connection "associated" means that the first spring end of the tension spring can be arranged or fastened on the binding body either directly or via an intermediate element, and the second spring end of the tension spring can be arranged or fastened on the cam body, either directly or via an intermediate element. Fastening the spring ends of the tension spring on the binding body and on the cam body, respectively, allows a direct force transmission between the spring arrangement and the binding body, on which the coupling means are arranged. In particular, spring end portions on the spring ends of the tension spring can be designed as hook portions or the like and can be suspended on a portion of the binding body or of the cam body, in order to transmit the release force via coupling means arranged on the binding body.

Furthermore, the object of the present invention formulated at the outset is achieved, according to a second aspect of the invention, by a heel unit for a gliding board binding, in particular for a touring binding, comprising a base having a fastening arrangement for fastening to a gliding board, a binding body which is rotatable relative to the base about a release axis of rotation that extends orthogonally to a gliding board plane, coupling means which are arranged on the binding body and are designed to be in engagement with a heel portion of a gliding board boot in a downhill position of the gliding board binding, in order to securely hold the gliding board boot on the gliding board binding, the coupling means protruding from the binding body, in the downhill position, in a gliding board longitudinal direction, in particular forwards in a direction of travel, and an Mz release mechanism which is designed to preload the coupling means into the downhill position in such a way that, in the downhill position, they are freed from the engagement with the gliding board boot upon action of a force exceeding a predetermined release force, and move out of the downhill position and into a release position by means of a rotational movement of the binding body about the release axis of rotation, the Mz release mechanism comprising a spring arrangement having a spring means, which determines the predetermined release force, and the Mz release mechanism comprising a cam body which is arranged on the binding body and is designed, in the downhill position, to enter link engagement with a mating contour of a cam surface provided on the base, the spring arrangement being designed to exert a spring force on the cam body, in order to bring it into link engagement with the mating contour of the cam surface, and the spring means being a torsion spring.

An important aspect of this solution according to the invention is therefore that the release force for the Mz release mechanism is provided by a torsion spring. An advantage of using a torsion spring as the spring means for the spring arrangement is for example that torsion springs can be designed so as to be relatively compact in the direction of a central axis of their windings, and the spring arrangement thus requires less installation space, in particular in the gliding board longitudinal direction, as a result of which the entire arrangement of the heel unit can be designed so as to be more compact. The torsion spring can also be arranged having the central axis of the spring windings in the gliding board longitudinal direction, gliding board transverse direction, or in a direction perpendicular to the gliding board plane, which results in significant structural design freedom. In the present invention, it is in particular intended for the torsion spring to be arranged having its central axis perpendicular to the gliding board plane, in order to keep the heel unit compact in the gliding board longitudinal direction.

Torsion springs are used to generate a torque or to accumulate rotation energy in a structure. Within the meaning of the present invention, further designations such as leg spring or coil spring are relevant for the "torsion spring" type of spring. These terms can equally be used instead of "torsion spring".

Advantageously, a first spring leg of the torsion spring can be supported on a portion of the binding body and/or a second spring leg of the torsion spring can be supported on a portion of the Mz release mechanism, in particular on a portion of the cam body. Supporting the spring legs of the torsion spring on the binding body and on the cam body, respectively, allows a direct force transmission between the spring arrangement and the binding body, on which the coupling means are arranged. In particular, it is intended for the first spring leg of the torsion spring to press directly against a portion on the binding body, and/or for the second spring leg of the torsion spring to press directly against a portion on the cam body or an element associated with the cam body, in order to provide the release force for the Mz release mechanism and to transfer said force to the coupling means via the torsion spring.

In particular, it is intended for the cam body to be arranged pivotably on the binding body, in particular to be arranged on the binding body so as to be pivotable about a swivel pin that is in parallel with the gliding board plane and orthogonal to the release axis of rotation, or about a swivel pin that is in parallel with the release axis of rotation. A pivotable mounting of the cam body allows a defined movement thereof. As a result, a likelihood of jamming or the like of the cam body on the binding body can be reduced. Furthermore, less friction occurs than for example in the case of a displaceable arrangement of the cam body. The overall system is thus less susceptible to faults and is easier to service. However, alternatively a displaceable mounting of the cam body is also conceivable, i.e. the invention is not limited to a pivotable mounting of the cam body.

Particularly preferably, a spring preload of the spring means can be adjustable, in particular can be adjustable by means of an adjusting screw. As a result, the heel unit can advantageously be adapted for different users with different parameters, such as body weight, skiing ability age, gliding board boot length (changed torque by changing the lever arm length), etc. Overall, the safety for a user can be improved in this way. An adjustment screw can be operated in a simple manner by means of a commercially available screwdriver. Thus, simple handling with respect to a possibility of adjustment of a spring preload of the spring means of the spring arrangement of the Mz release assembly of the heel unit can be ensured.

The coupling means can in particular be two coupling pins which are arranged substantially side-by-side and which are designed to engage in recesses of the heel portion of the gliding board boot, in order to securely hold the gliding board boot on the gliding board binding, at least one of the coupling pins being movable relative to the other coupling pin in each case, in particular being able to be movable in a plane substantially in parallel with the gliding board plane. In this case, it is preferably intended for the two coupling pins to be movable away from one another in the plane substantially in parallel with the gliding board plane, counter to a resilient tensioning force. As a result, in addition to the Mz release, a front or My release can also be provided, in order to achieve a complete safety binding having Mz and My release. As mentioned at the outset, My is the torque in the event of a forwards inclination, for example falling forwards. Accordingly, in the case of the frontal or My release, the gliding board boot is freed upon action of a torque about the gliding board transverse direction (y-direction), when said torque exceeds an My release torque. Preferably, a spring preload of a spring means of an My release mechanism can also be adjustable, in order to be able to adapt the My release torque to different user parameters, such as body weight, skiing ability, age, gliding board boot length, etc.

The object of the invention, formulated at the outset, is also achieved by a touring binding comprising a heel unit according to the first or the second aspect of the present invention.

Figure 2:
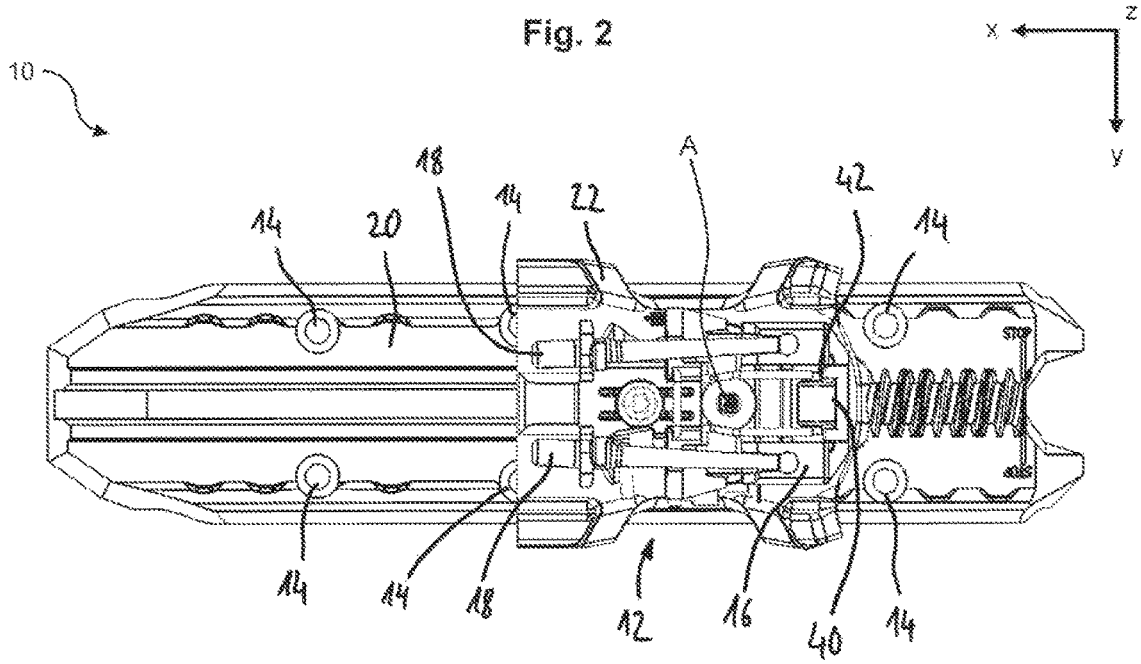
Figure 3:
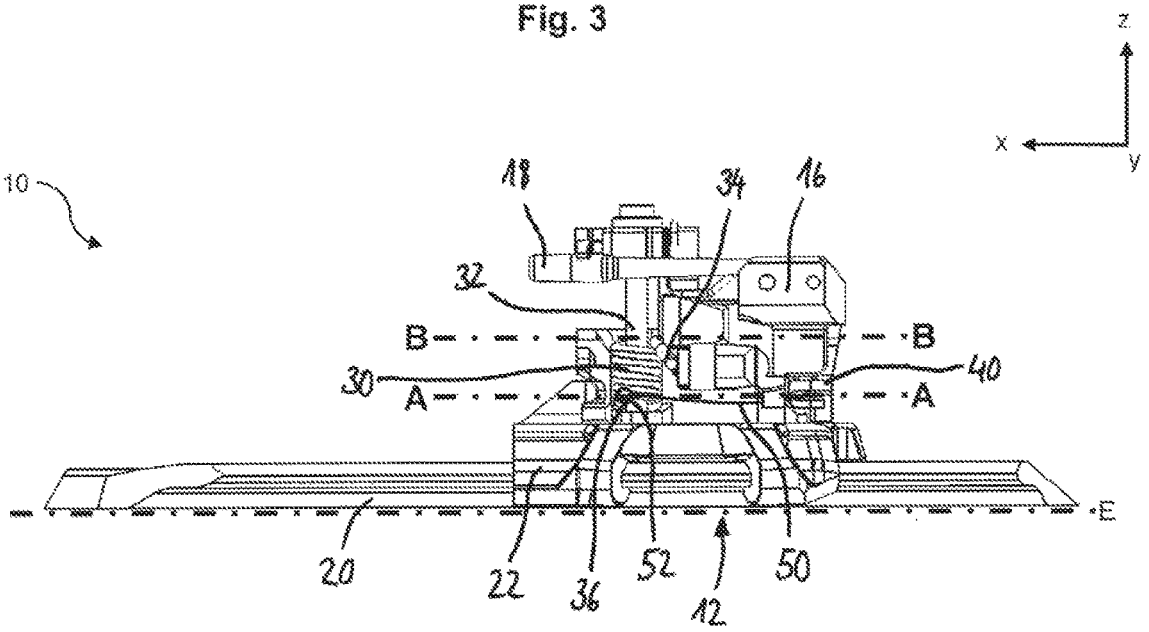
Figure 4:
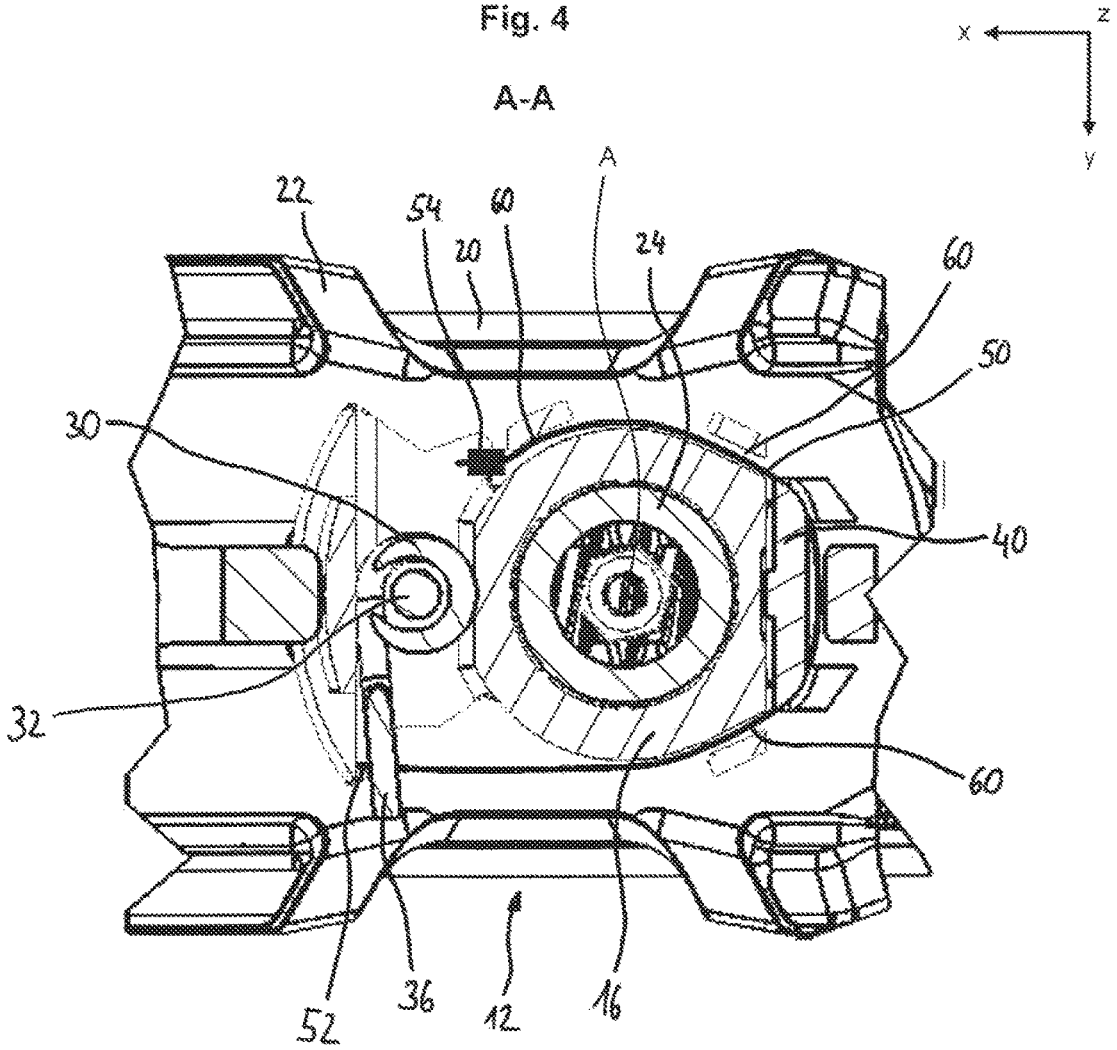
Figure 5:
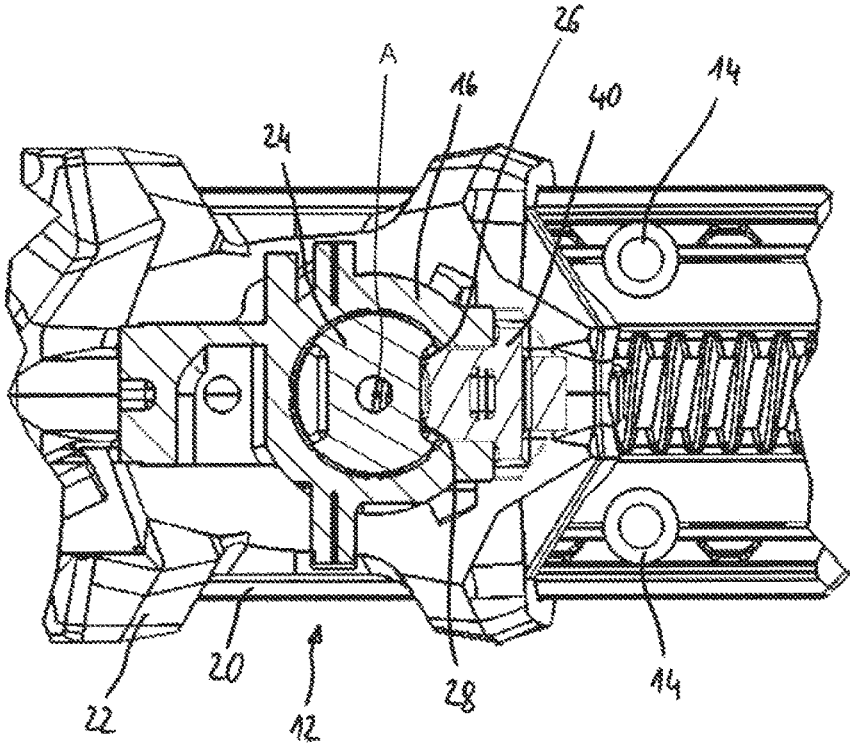
Figure 6:
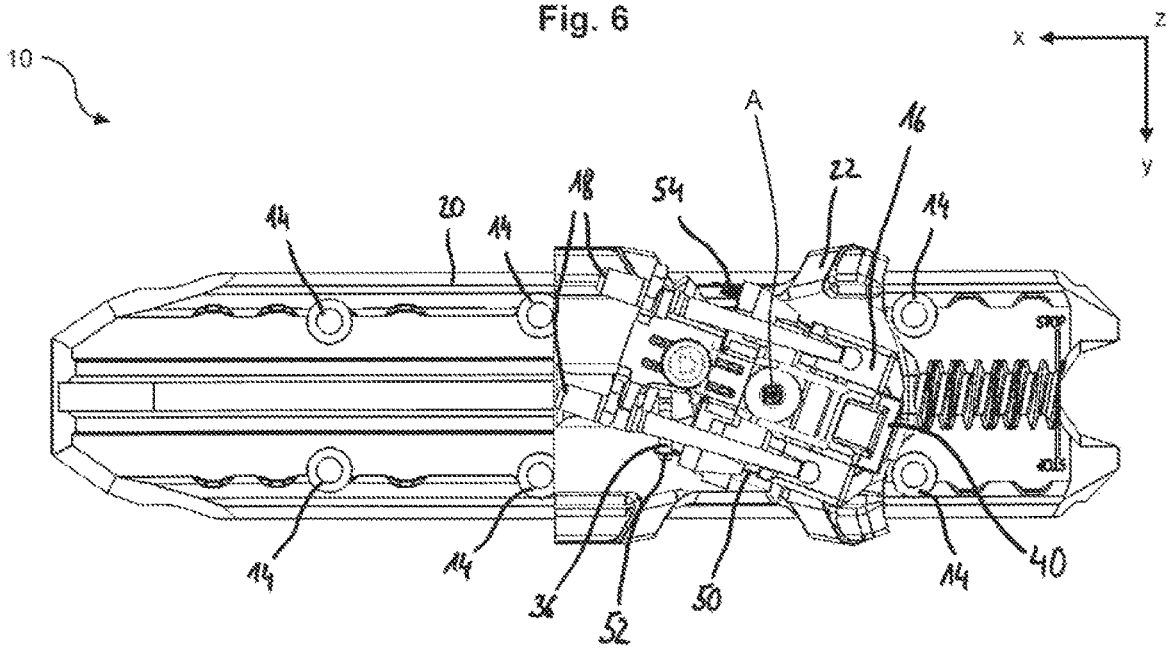
Figure 7:
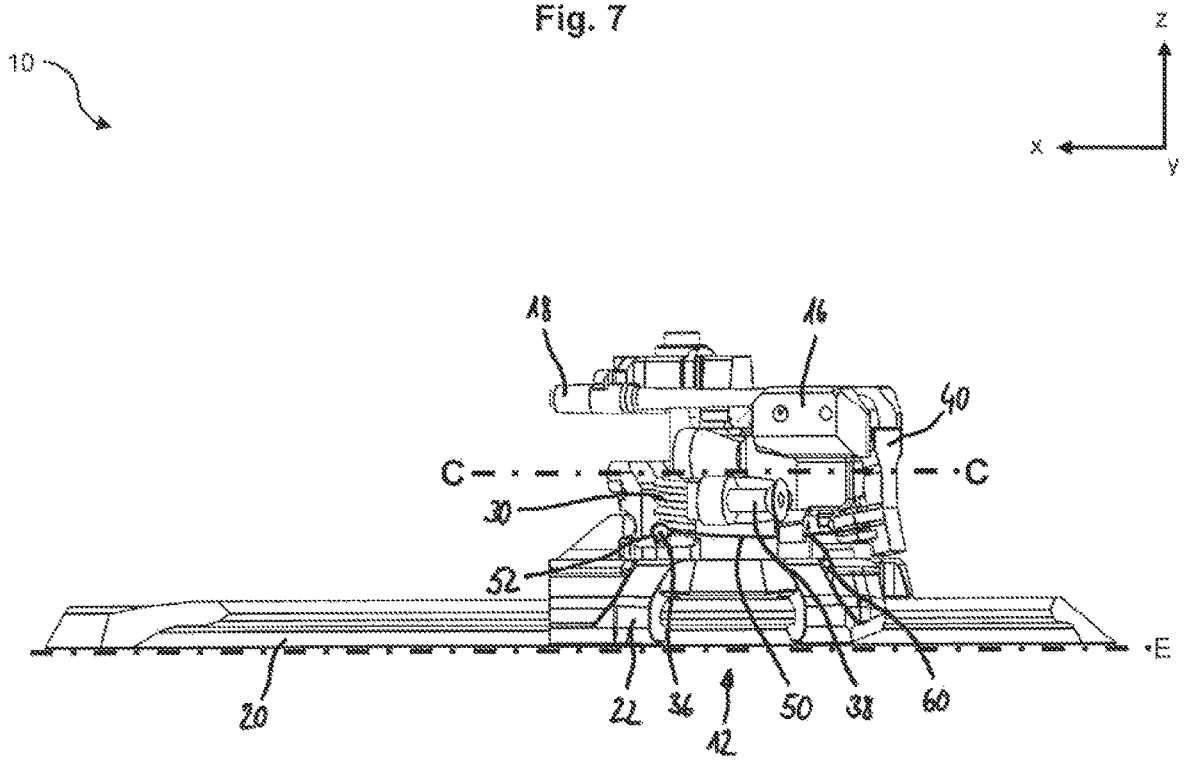
Figure 8:
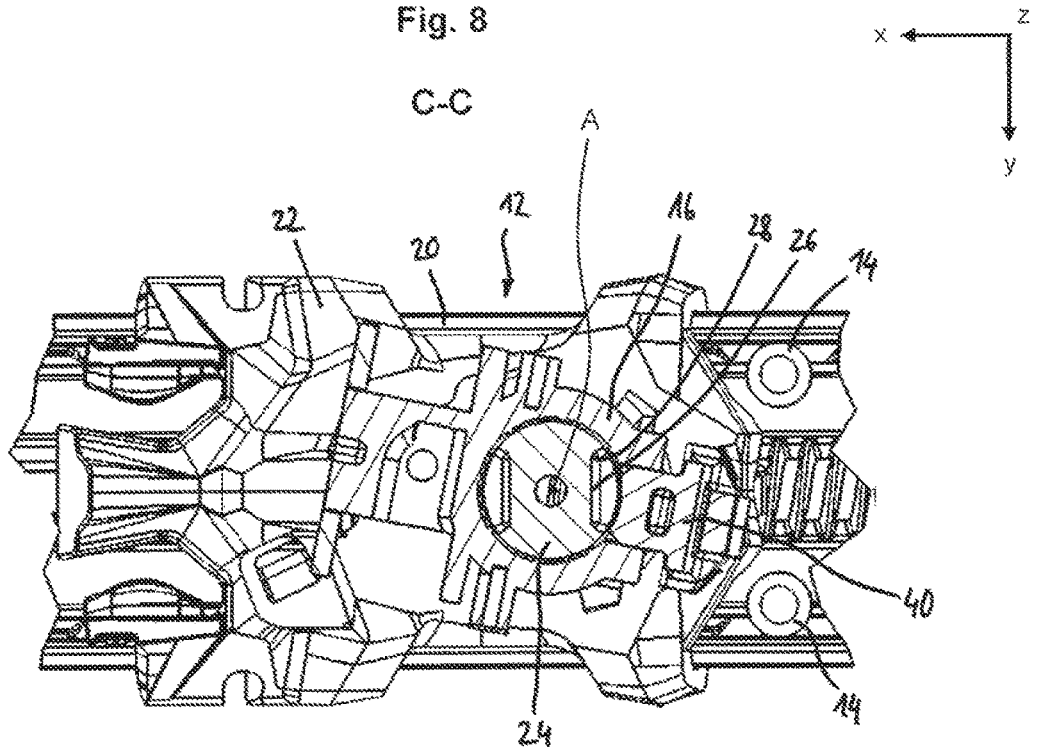
Figure 9:
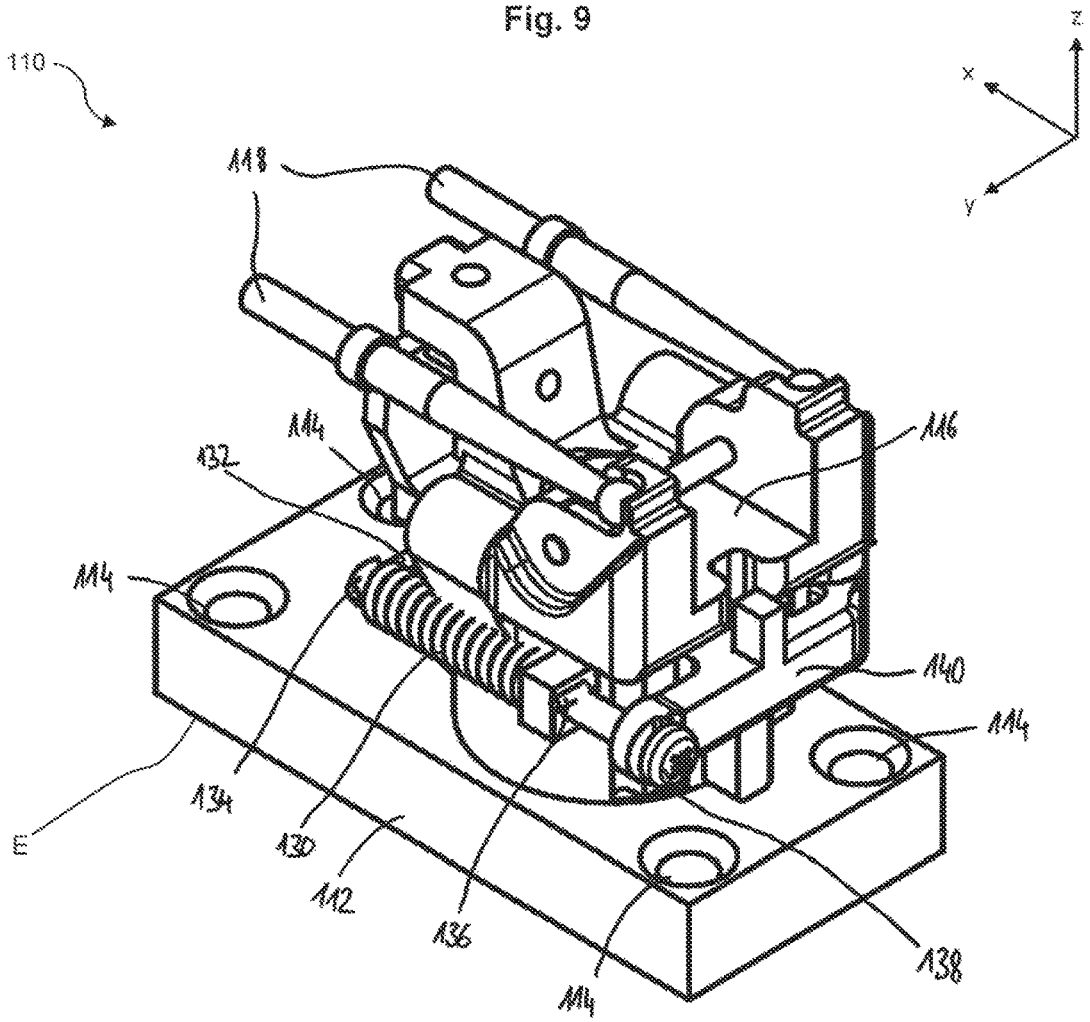
Figure 10:
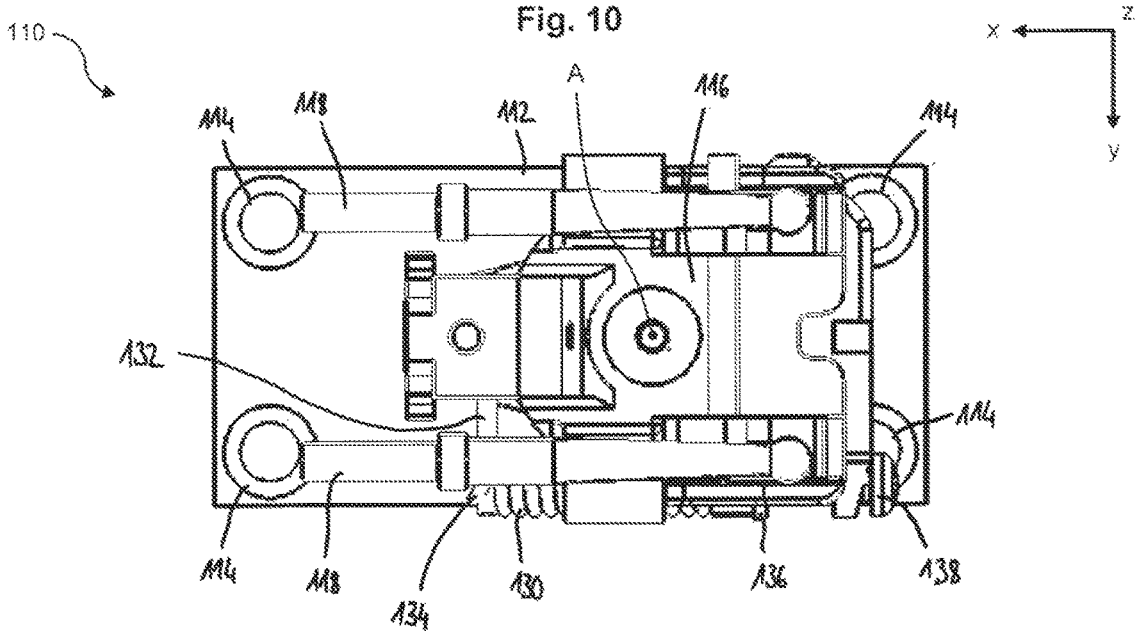
Figure 11:
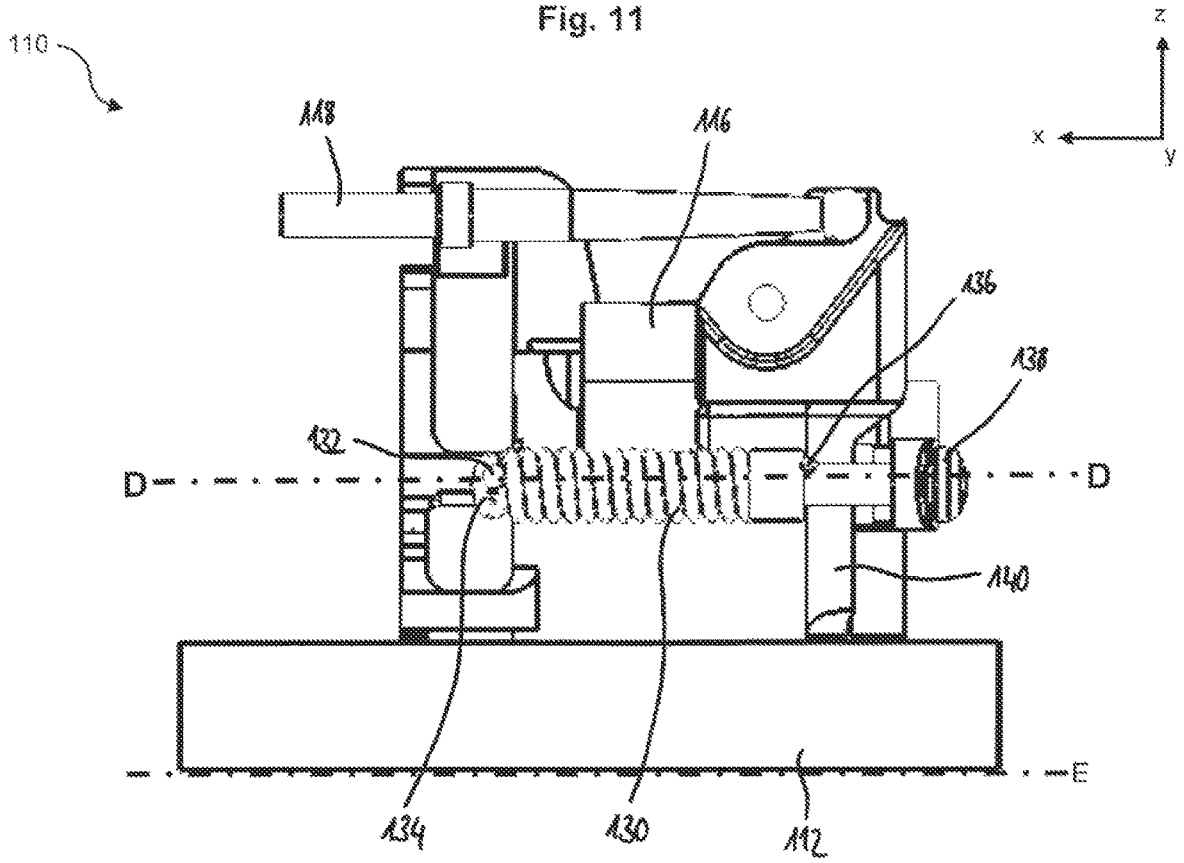
Figure 12:
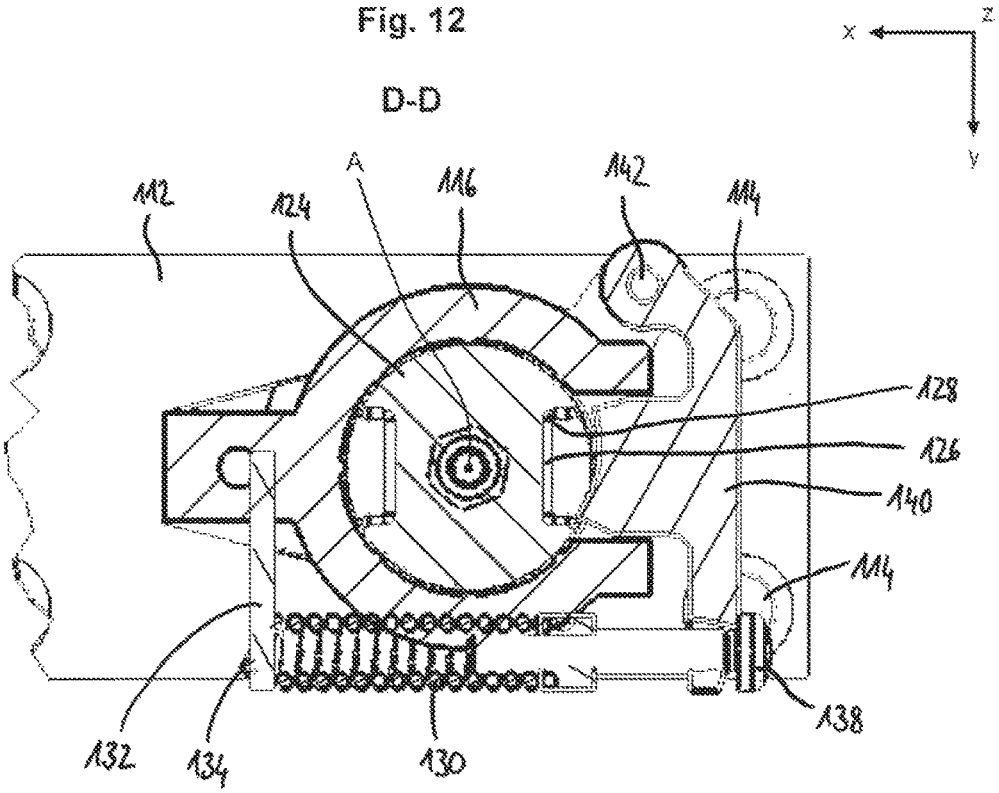
Figure 13:
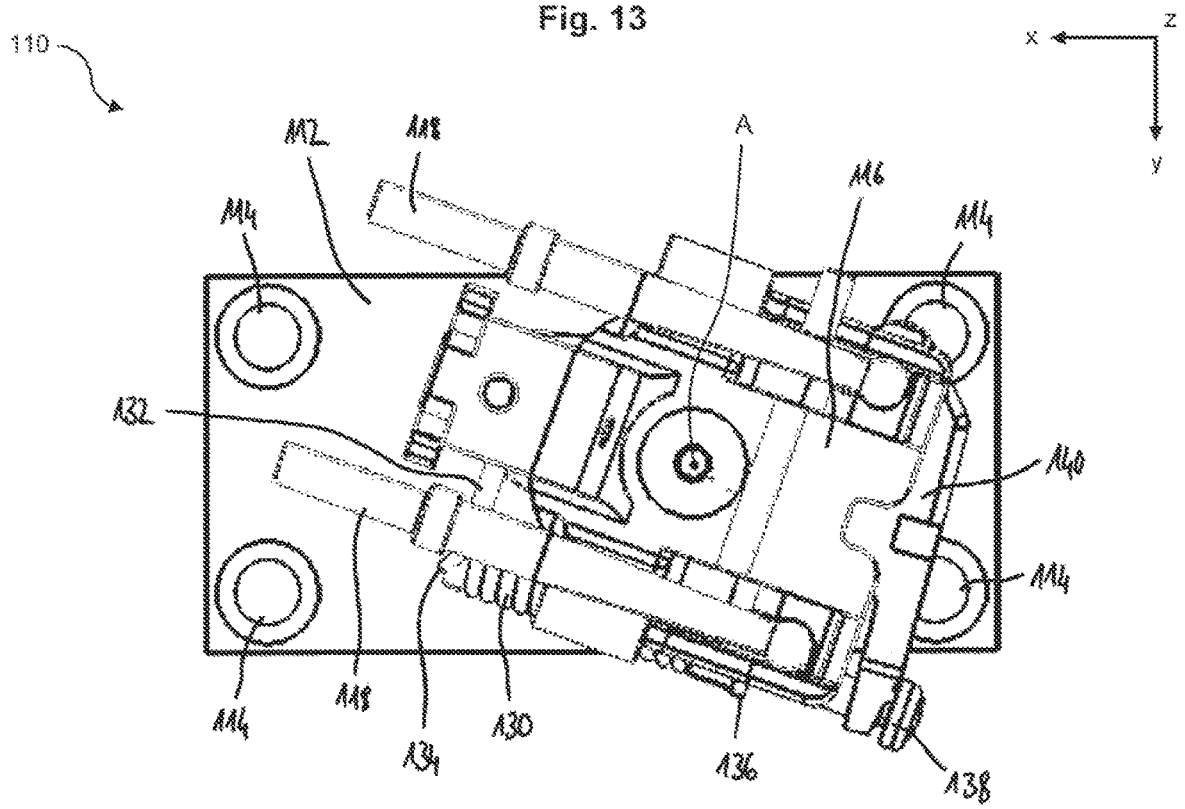
Figure 14:
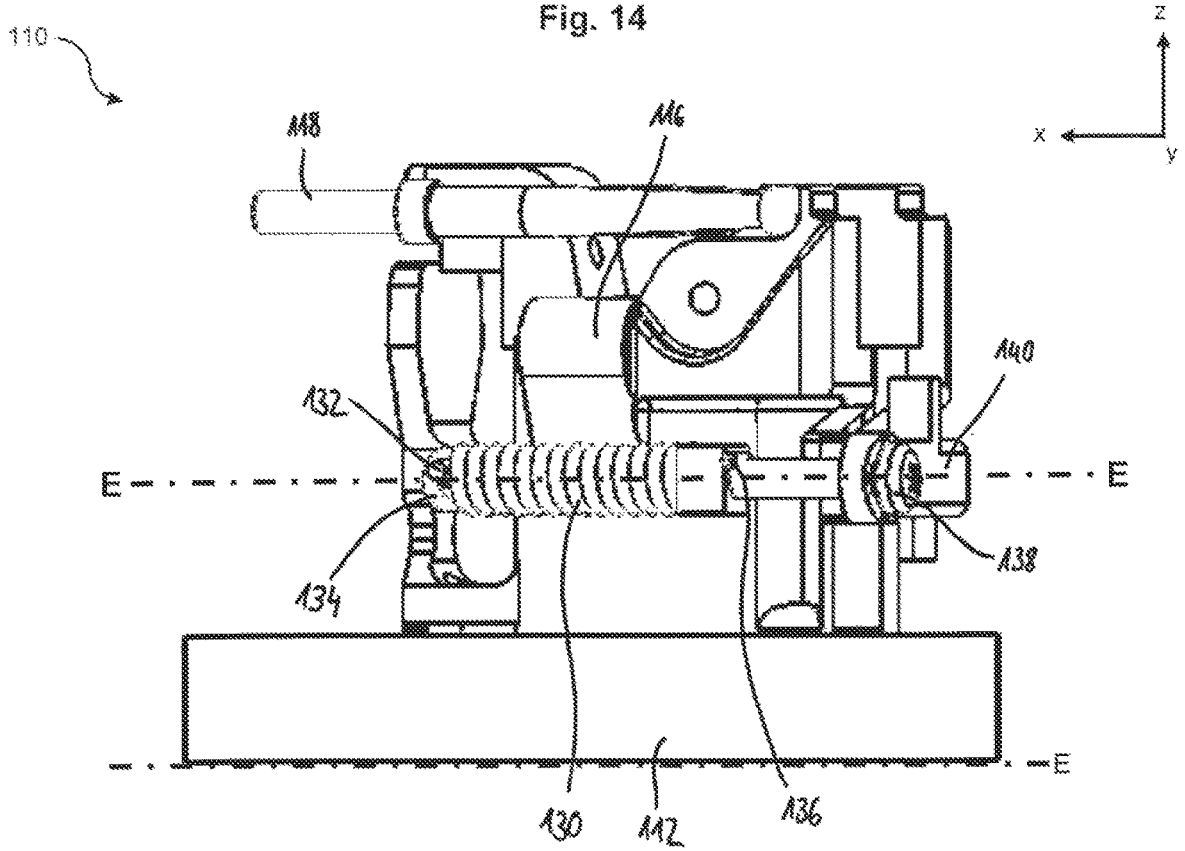
Figure 15:
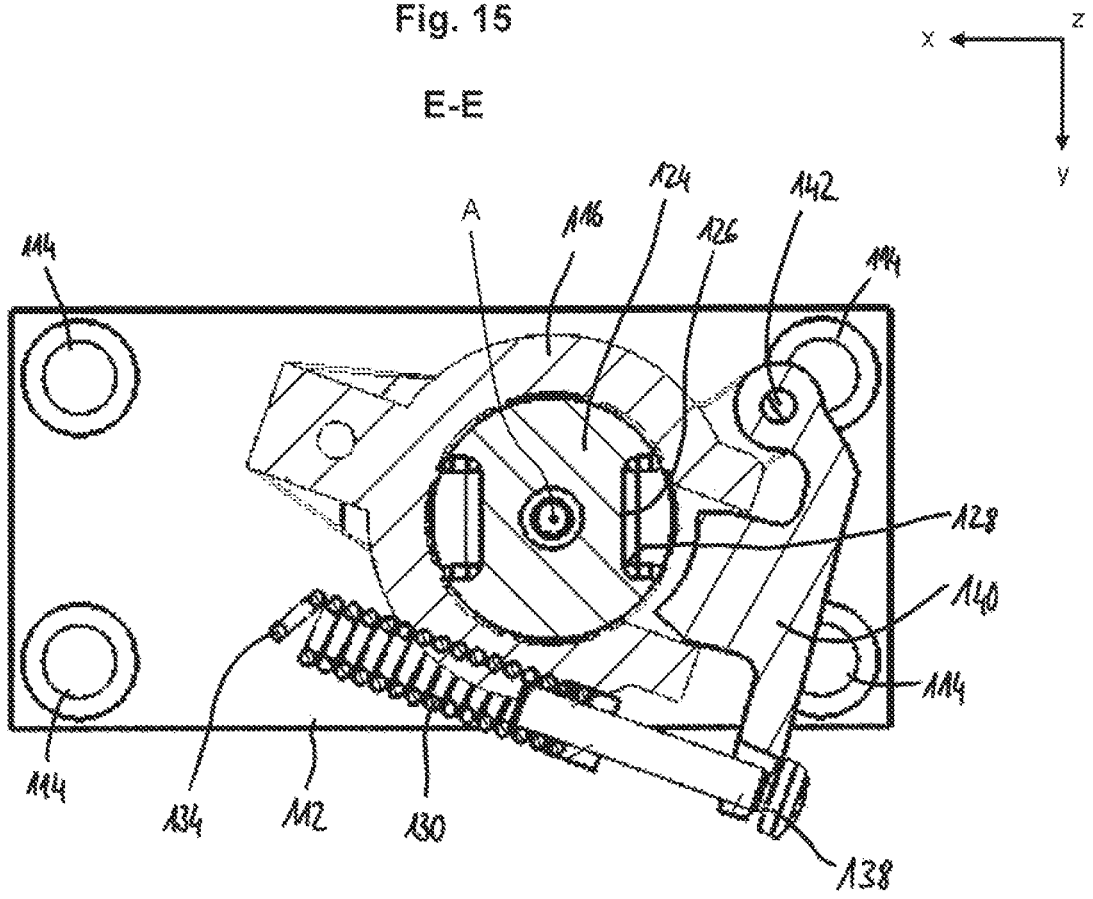
Figure 16:
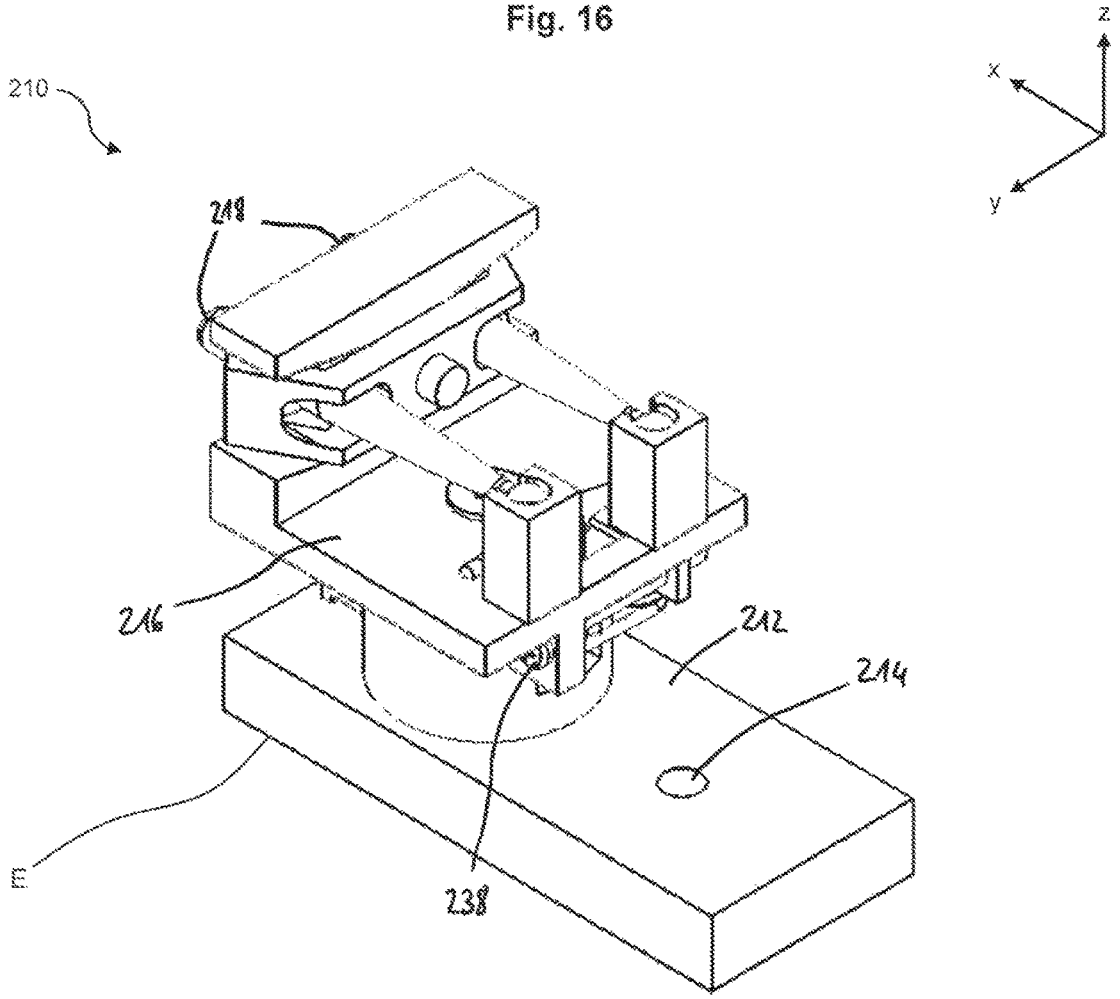
Figure 17:
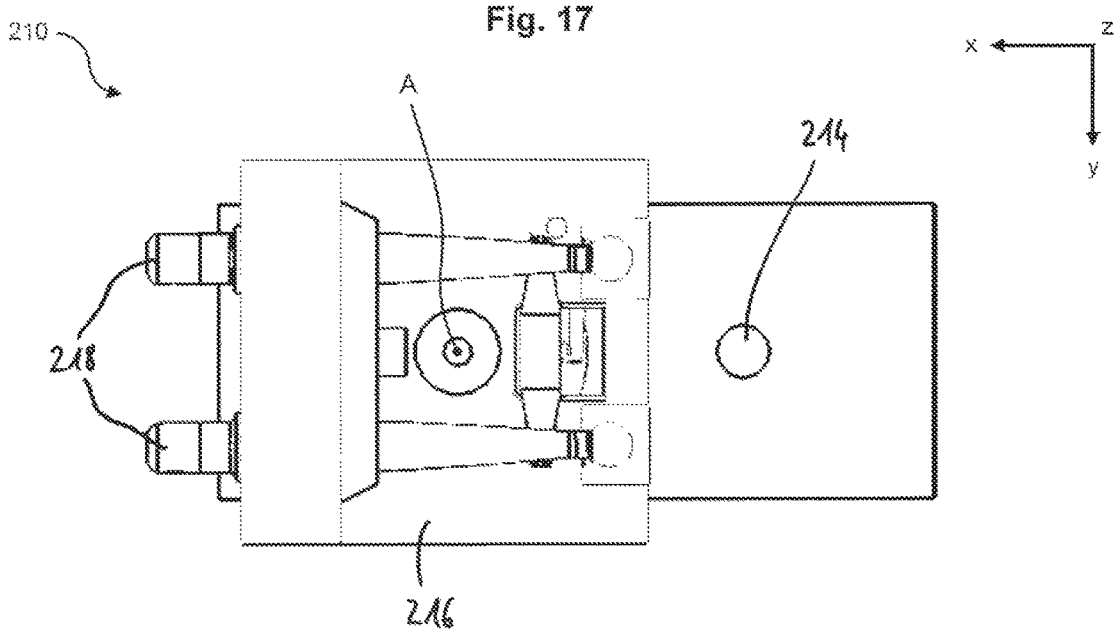
Figure 18:
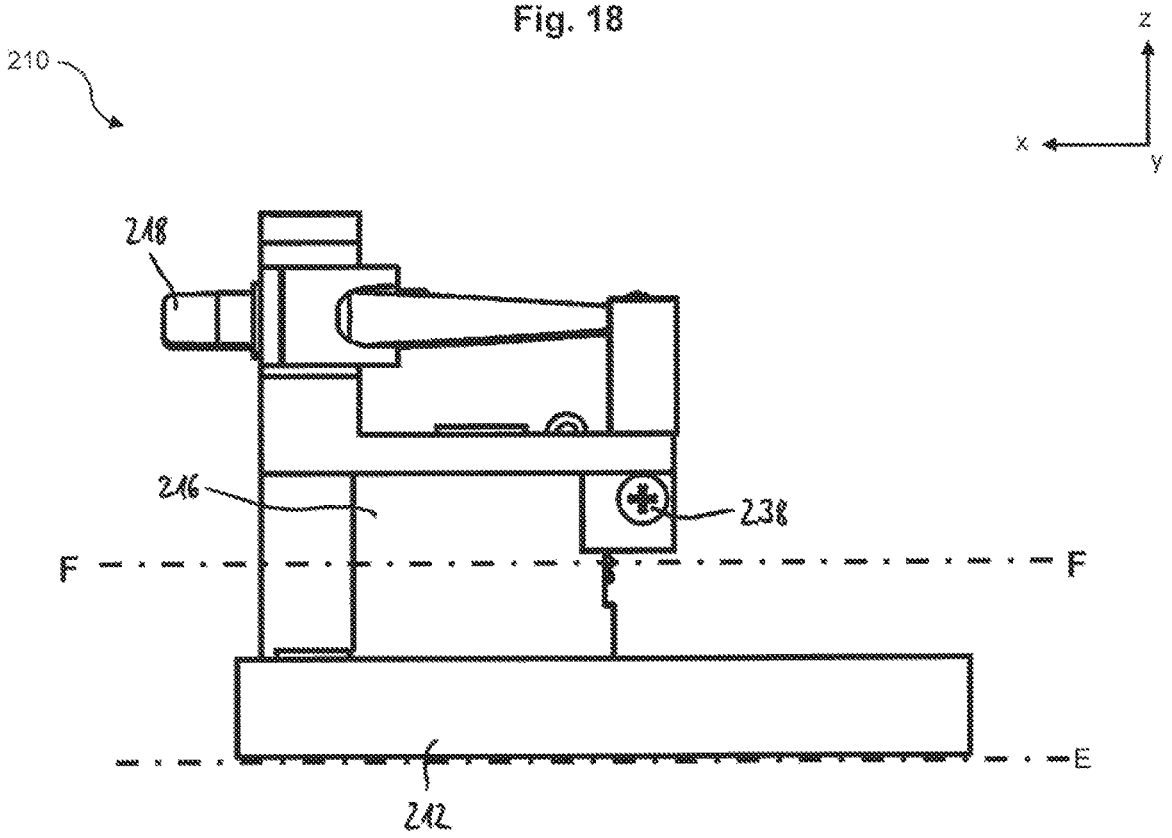
Figure 19:
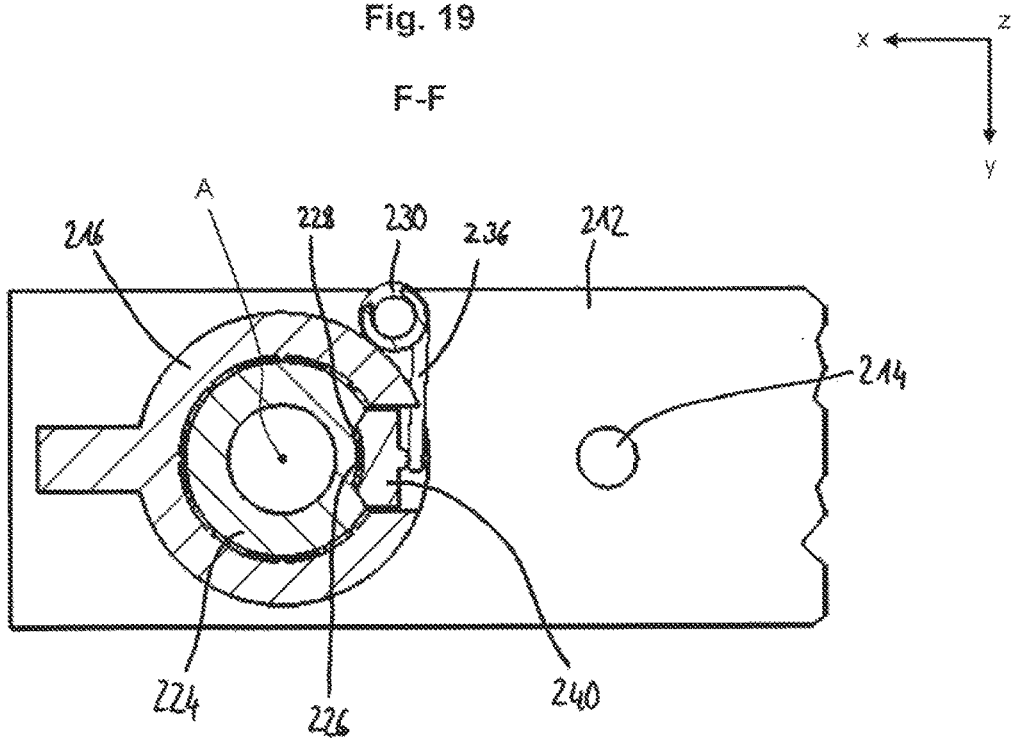
Figure 20:
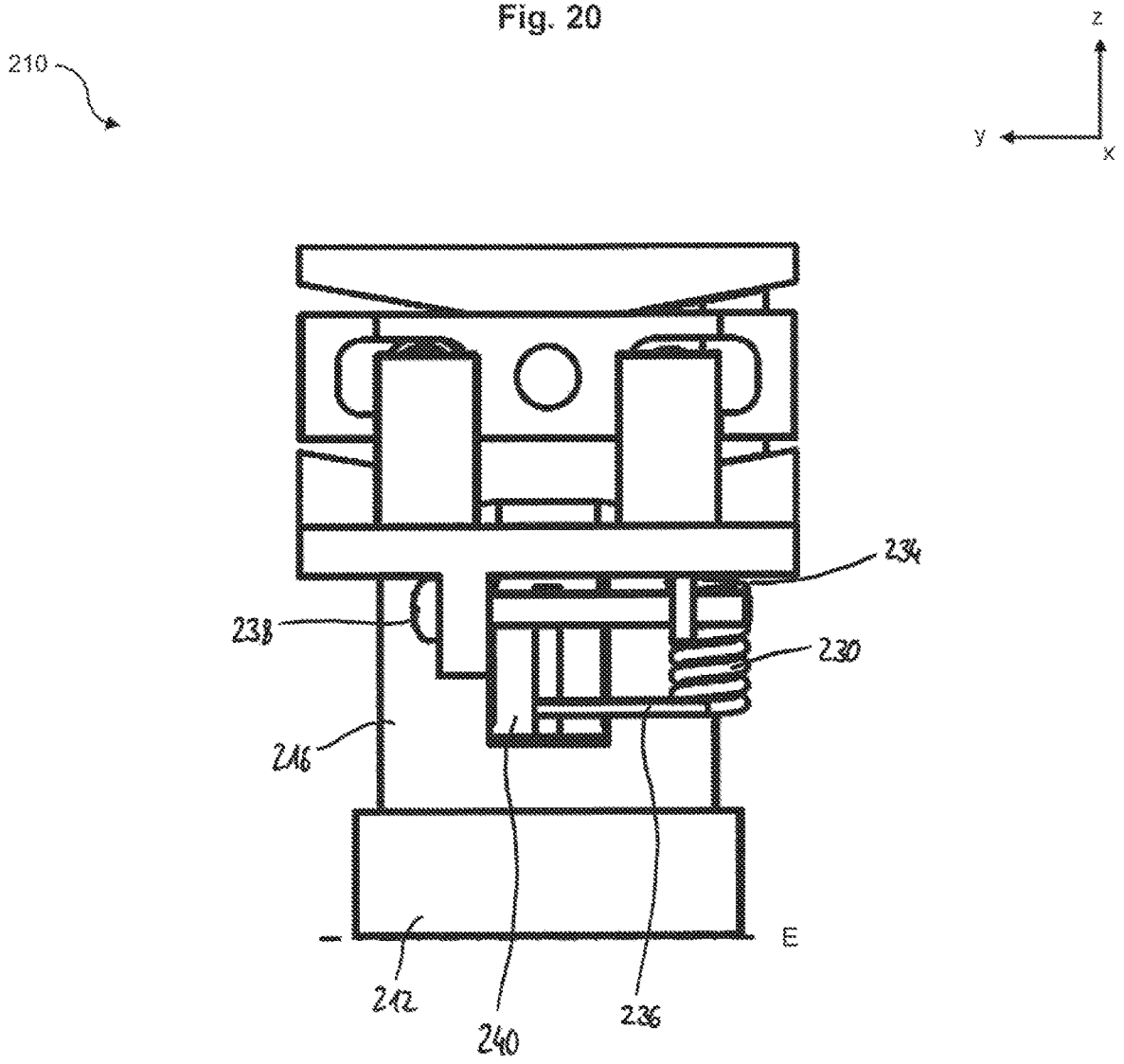
Figure 21:
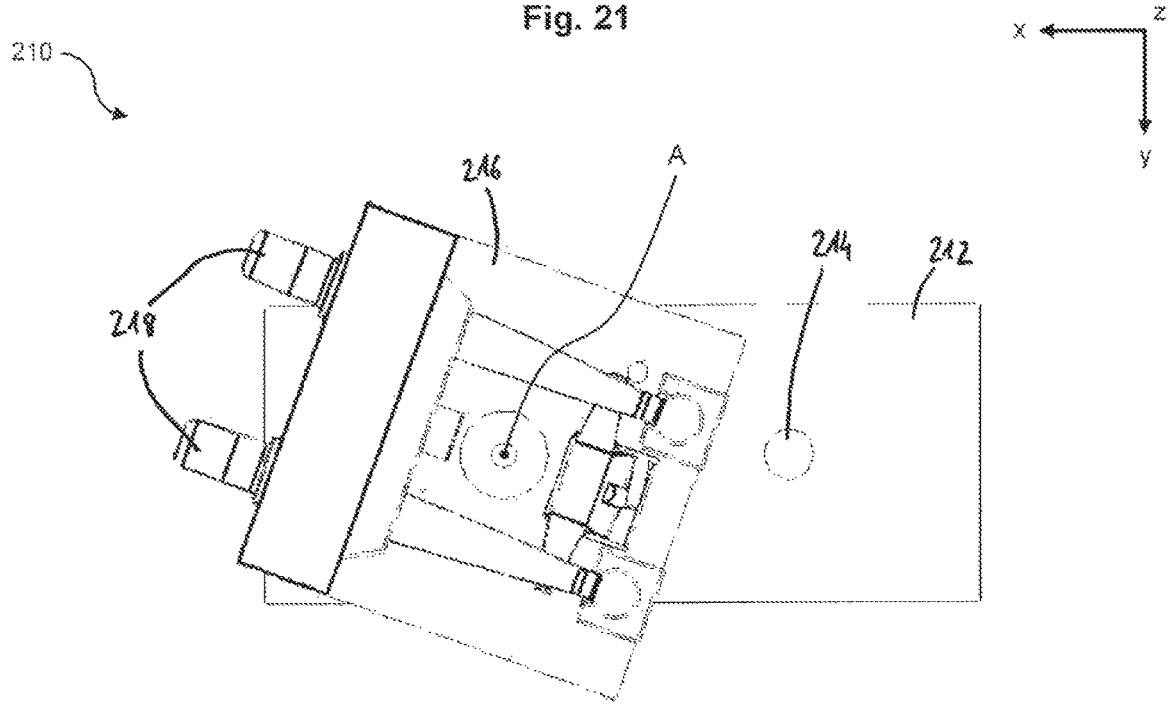
Figure 22:
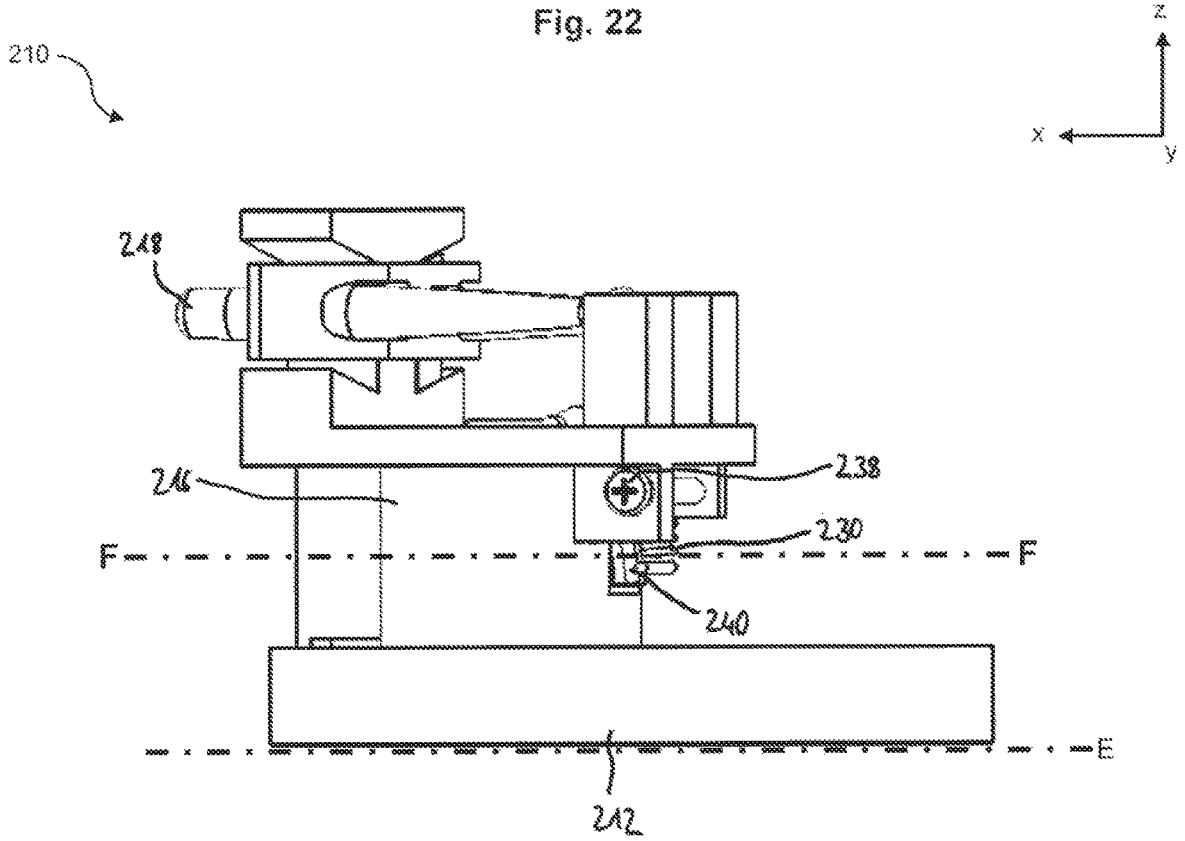
Figure 23:
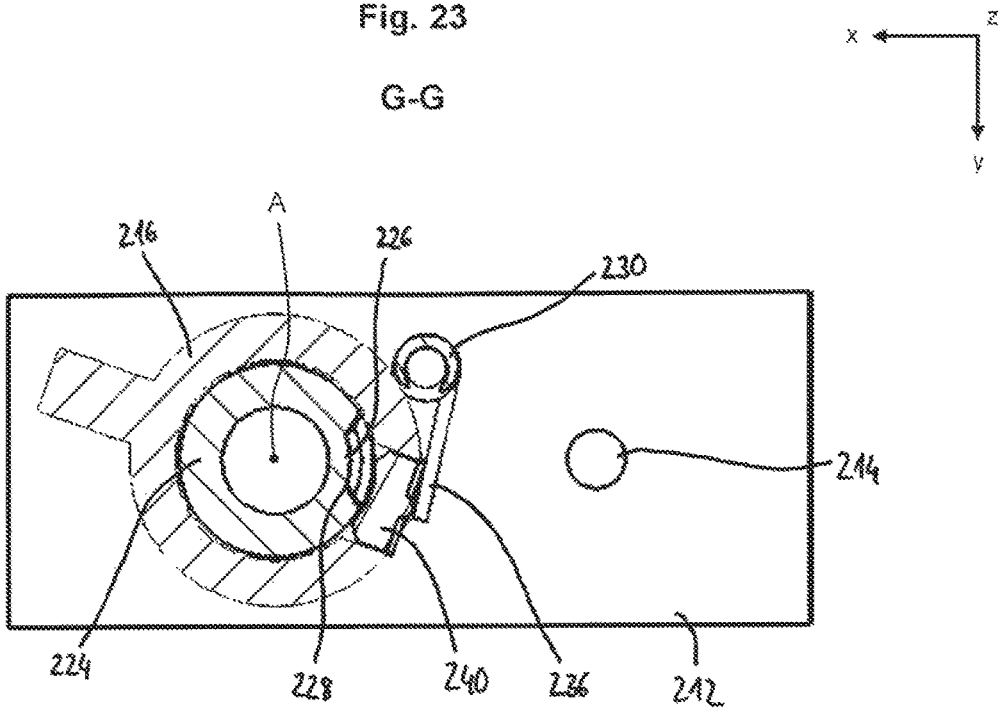
Figure 24:
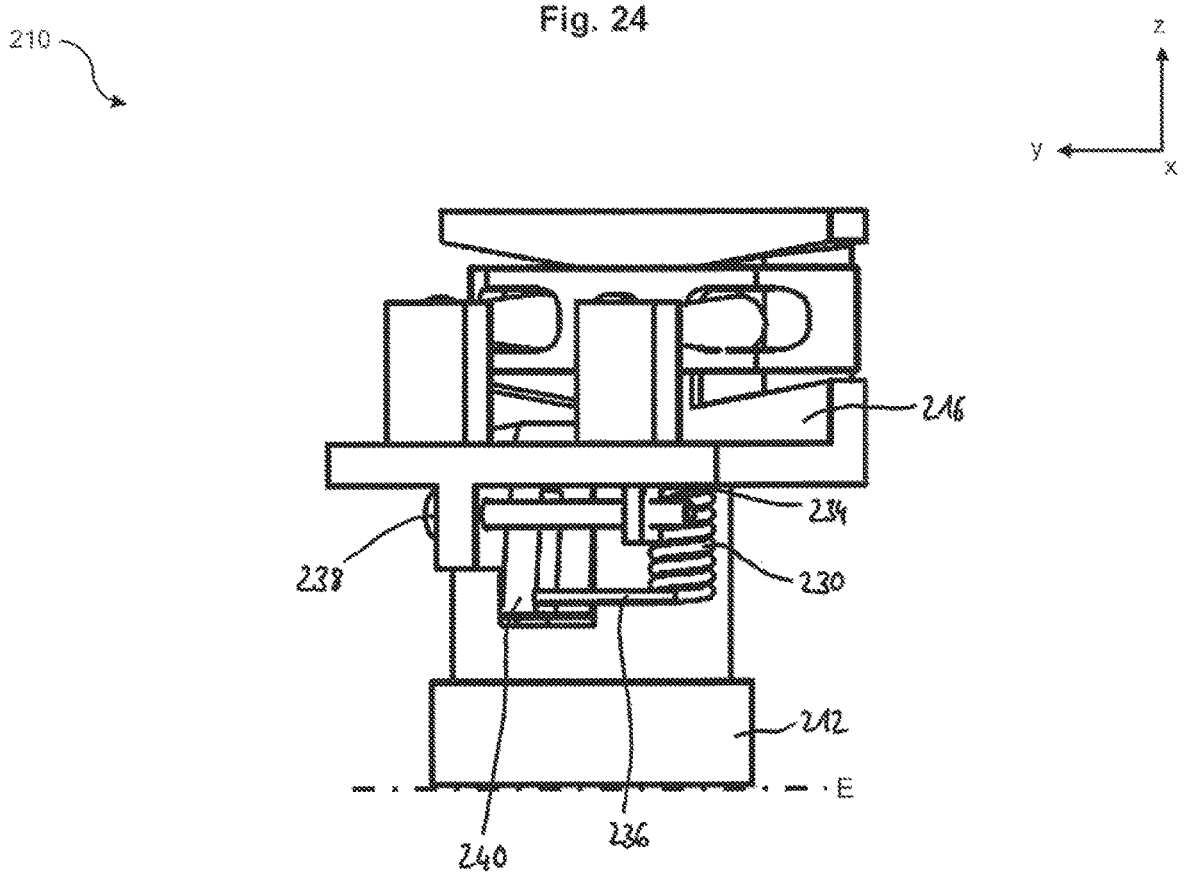

The invention will be explained in greater detail in the following, on the basis of preferred embodiments and with reference to the accompanying drawings, in which:

FIG. 1 is a perspective view of a heel unit according to a first embodiment of the present invention, in a downhill position, FIG. 2 is a plan view of the heel unit of the first embodiment, in the downhill position, FIG. 3 is a side view of the heel unit of the first embodiment, in the downhill position, FIG. 4 is a sectional view, along the line A-A in FIG. 3, of the heel unit of the first embodiment, in the downhill position, FIG. 5 is a sectional view, along the line B-B in FIG. 3, of the heel unit of the first embodiment, in the downhill position, FIG. 6 is a plan view of the heel unit of the first embodiment, in the release position, FIG. 7 is a side view of the heel unit of the first embodiment, in the release position, FIG. 8 is a sectional view, along the line C-C in FIG. 6, of the heel unit of the first embodiment, in the release position, FIG. 9 is a perspective view of a heel unit according to a second embodiment of the present invention, in a downhill position, FIG. 10 is a plan view of the heel unit of the second embodiment, in the downhill position, FIG. 11 is a side view of the heel unit of the second embodiment, in the downhill position, FIG. 12 is a sectional view, along the line D-D in FIG. 10, of the heel unit of the second embodiment, in the downhill position, FIG. 13 is a plan view of the heel unit of the second embodiment, in a release position, FIG. 14 is a side view of the heel unit of the second embodiment, in the release position, FIG. 15 is a sectional view, along the line E-E in FIG. 13, of the heel unit of the second embodiment, in the release position, FIG. 16 is a perspective view of a heel unit according to a third embodiment of the present invention, in a downhill position, FIG. 17 is a plan view of the heel unit of the third embodiment, in the downhill position, FIG. 18 is a side view of the heel unit of the third embodiment, in the downhill position, FIG. 19 is a sectional view, along the line F-F in FIG. 17, of the heel unit of the third embodiment, in the downhill position, FIG. 20 is a rear view of the heel unit of the third embodiment, in the downhill position, FIG. 21 is a plan view of the heel unit of the third embodiment, in a release position, FIG. 22 is a side view of the heel unit of the third embodiment, in the release position, FIG. 23 is a sectional view, along the line G-G in FIG. 21, of the heel unit of the third embodiment, in the release position, and FIG. 24 is a rear view of the heel unit of the third embodiment, in the release position.

A heel unit of a first embodiment of the invention, denoted in a general manner by 10 in FIGS. 1 to 8, comprises a base 12 for fastening the heel unit 10 on a gliding board (not shown). A fastening arrangement of the base 12, implemented for example by fastening holes 14 for fastening screws, and a lower support surface of the base 12, define a gliding board plane E corresponding to a surface of the gliding board on which the heel unit 10 is to be mounted. Furthermore, an X-axis (gliding board longitudinal direction or x-direction), which is oriented in the direction of travel of the gliding board, a Y-axis (gliding board transverse direction or y-direction), which extends orthogonally to the X-axis and in parallel with the gliding board plane E, and a Z-axis (vertical direction or z-direction), which extends orthogonally to the gliding board plane E, are defined by the base 12.

The base 12 can be formed in two parts, having a first base element 20, in particular in the form of a base plate 20, which, for the purpose of fastening to the gliding board, comprises for example the fastening arrangement for fastening by means of screws (corresponding drilled holes 14 in the first base element 20), and having a second base element 22, in particular in the form of a longitudinally displaceable carriage 22, which can be attached to the first base element 20. The second base element 22 can be retained on the first base element 20 so as to be displaceable in the x-direction, in order to allow a longitudinal positioning of the heel unit 10 for adaptation to a boot size, and/or to allow some degree of mobility of the heel unit 10 relative to the gliding board along the X-axis, in a predetermined dynamic movement range.

The heel unit 10 further comprises a binding body 16 which, for the purpose of adjusting the heel unit 10 between a downhill position shown in FIGS. 1 to 5 and a release position shown in FIGS. 6 to 8, is rotatable relative to the base 12 about a release axis of rotation A extending orthogonally to the gliding board plane E (see the plan and sectional views of FIGS. 2, 4, 6 and 8). The release axis of rotation A thus extends in the z-direction. In particular, as can be seen in the sectional views of FIGS. 4, 5 and 8, the second base element 22 can comprise a journal portion 24 which extends substantially in the z-direction and about which the binding body 16 can be rotatably mounted.

The heel unit 10 further comprises, on the binding body 16, coupling means 18 for coupling to a gliding board boot, in order to hold the gliding board boot firmly in the downhill position of the heel unit 10. The coupling means 18 can, in particular in the downhill position, protrude from the binding body 16 in the x-direction, in particular in the direction of travel, and, in the release position, can be twisted laterally to the left or right, together with the binding body 16, relative to the base 12, about the release axis of rotation A in a predetermined angle of rotation, depending on the direction of the force action. In a manner known per se, the coupling means 18 can be formed by two coupling pins 18 which are arranged side-by-side and extend substantially in the x-direction, and which extend in a plane substantially in parallel with the gliding board plane E and protruded forwards from the heel unit 10 in the downhill position, in the direction of travel, at least one of the coupling pins 18 being movable relative to the other coupling pin in each case, in particular being movable in the plane substantially parallel to the gliding board plane E. The coupling pins 18 can be separate pins or can form ends of a U-shaped bracket. In a manner known per se, the coupling pins 18 are preferably preloaded, by an My release mechanism, into their position ready for engagement, such that they securely hold the heel portion of the gliding board boot. When a predetermined release force is overcome, the coupling pins 18 can move away from one another in the y-direction, said movement taking place counter to the effect of an My release spring. An example for a release mechanism of this kind is in turn known from EP 2 545 966 A2, the content of which with respect to said release mechanism is intended to be incorporated in full in this disclosure. Alternatively, the coupling pins 18 can be formed by the front ends of a U-shaped bracket element, which is held securely on the heel unit 10 in such a way that the two coupling pins 18 are movable, by elastic deformation of the U-shaped bracket element, in order to allow an My-release of the heel unit 10.

The heel unit 10 comprises an Mz release mechanism which is designed to preload the coupling means 18 into the downhill position in such a way that, in the downhill position, they are freed from the engagement with the gliding board boot upon action of a force exceeding a predetermined release force, and move out of the downhill position and into the release position by means of a rotational movement of the binding body 16 about the release axis of rotation A. The Mz release mechanism comprises a spring arrangement having a spring means 30 which determines the predetermined release force. Furthermore, the Mz release mechanism comprises a cam body 40 which is arranged on the binding body 16 and is designed, in the downhill position, to enter into link engagement with a mating contour 28 of a cam surface 26 provided on the base 12, in particular on the journal portion 24.

By means of the spring arrangement, according to the invention a tractive force is exerted on the cam body 40 in order to draw it into link engagement with the mating contour 28 of the cam surface 26, and thereby to preload the heel unit 10 or the binding body 16 and the coupling means 18 into the downhill position.

The cam body 40 can in particular be mounted on the binding body 16 so as to be pivotable about a swivel pin 42, in particular on an end of the heel unit 10 that is to the rear in a direction of travel or x-direction. In the first embodiment, the swivel pin 42 can extend substantially in parallel with the gliding board plane E and substantially orthogonally to the release axis of rotation A. In this way, in the case of a pivot movement about the swivel pin 42 the cam body 40 can be movable away from the binding body 16, counter to the preload force of the spring means 30, and movable towards the binding body 16 or preloaded towards the binding body 16 by the spring means 30.

In the case of the first embodiment, the spring means can in particular be a torsion spring 30 having two spring legs 34, 36. A spring preload of the spring means 30 can preferably be adjustable, in particular by means of an adjustment screw 38 which is fastened on the binding body 16 and presses on the first spring leg 34. The Mz release mechanism can comprise a cable element 50 which transfers the tractive force or the preload force of the spring means 30, in particular the torsion spring 30, onto the cam body 40. A first spring leg 34 of the torsion spring 30 can, as is visible for example in FIG. 3, be supported on the binding body 16, and a second spring leg 36 of the torsion spring 30 can be supported on a portion of the cable element 50, in particular on a first end portion 52 of the cable element 50. The first end portion 52 of the cable 50 can in particular be designed as a loop 52 at the cable end, which is suspended on the second spring leg 36, as can be seen e.g. in FIG. 1. As is clear for example from FIG. 2 or 4, a second cable end 54 can be fixed on the binding body 16, for example by means of a seal. Alternatively, a cable loop suspended on a protrusion of the binding body 16 is conceivable here too, or any other suitable connection by means of which the cable end 54 can be reliably secured on the binding body 16 or another element fixed to the binding body.

In particular, proceeding from the first spring leg 34, the cable element 50 can be guided around the binding body 16 and fixed to said binding body for example by a seal 54 or in another manner, on a side of the binding body 16 opposite the torsion spring 30 or the first spring leg 34. With reference to FIG. 4—a sectional view in a plane in parallel with the gliding board plane E at the height of the cable element 50—the cable element 50 can be guided, between the end portions 52, 54 thereof, on the binding body 16 by means of guide portions 60, in order to stabilise the position of the cable 50. Guide portions 60 of this kind can be implemented for example by protrusions on the binding body 16, which engage above or below the cable element 50. In addition, the cable element 50 can also be guided on the cam body 40 or connected to the cam body 40 in another manner, in order to transfer the tractive force of the spring means 30, in particular of the torsion spring 30, to the cam body 40.

As mentioned above, the downhill position of the heel unit 10 is shown in FIGS. 1 to 5, while the release position of the heel unit 10 is shown in FIGS. 6 to 8. In the case of a comparison of FIGS. 1 to 5 with FIGS. 6 to 8 it can firstly be seen that the coupling means 18 protrude from the binding body 16 in the direction of travel x, in the downhill position (cf. for example FIG. 2), and in the release position are twisted, together with the binding body 16, relative to the base 12, in particular about the journal portion 24 of the carriage 22 (cf. for example FIG. 6.

With reference to FIGS. 5 and 8—sectional views in a plane in parallel with the gliding board plane E, at the height of the mating contour 28 of the cam surface 26, which is formed on the journal portion 24 of the base 12—an Mz release of the heel unit 10 according to the first embodiment of the present invention by means of the Mz release mechanism is explained. In FIG. 5 the part of the cam body 40 protruding in the direction of the binding body 16 is preloaded into a recess on the journal portion 24, formed by the mating contour 28 on the cam surface 26, on account of the tractive force exerted on the cam body 40 via the cable element 50. In comparison therewith, FIG. 8, which is a sectional view along the lines C-C in FIG. 7, shows a state during or after an Mz release. In this state, a force that exceeds the Mz release force acts (or has acted) on the coupling means 18, in particular from a lateral direction, resulting in a torque about the Z-axis. Such a state arises for example in the case of the user falling or as a result of lateral impacts which the gliding board undergoes during travel. It can be seen that the cam body 40 has moved along the mating contour 28 of the cam surface 26 due to the rotational movement of the coupling means 18 and thus of the binding body 16 on which it is mounted, and has been pushed backwards in the direction of travel due to a sliding movement along said link surface in conjunction with a rotational or pivot movement about the swivel pin 42, counter to the spring preload transferred by the cable element 50. Thus, the arrangement allows a rotation of the coupling means 18 and of the binding body 16 with respect to the base 12 of the heel unit 10, but counter to the spring force of the spring means 30, which can be transferred via the cable element 50 in the case of the present embodiment.

A second embodiment of the invention will be explained in greater detail in the following, with reference to FIGS. 9 to 15 In this case, only the differences with respect to the first embodiment are discussed in greater detail, and otherwise reference is made to the description of the first embodiment. All of the features and functions of the first embodiment which are not described again here can also be transferred in the same or at least in a very similar manner to the second embodiment. Accordingly, the explanations regarding the X-, Y- and Z-axis, and x-, y- and z-direction in the description of the first embodiment of the invention also apply equally for the second embodiment.

With reference to FIG. 9, a heel unit 110 of the second embodiment also comprises a base 112 for fastening the heel unit 110 on a gliding board (not shown). A fastening arrangement of the base 112, implemented for example by fastening holes 114 for fastening screws, and a lower support surface of the base 112, again define a gliding board plane E corresponding to a surface of the gliding board on which the heel unit 110 is to be mounted. Furthermore, the heel unit 110 comprises a binding body 116 which is again rotatable relative to the base 112 about a release axis of rotation A extending orthogonally to the gliding board plane E. The base 112 can, as in the first embodiment, comprise a journal portion 124 (see FIGS. 12 and 15), about which the binding body 116 can rotate.

The heel unit 110 comprises an Mz release mechanism which is designed to preload the coupling means 118 into the downhill position in such a way that, in the downhill position, they are freed from the engagement with the gliding board boot upon action of a force exceeding a predetermined release force, and move out of the downhill position and into the release position by means of a rotational movement of the binding body 116 about the release axis of rotation A. The coupling means 118 can again be implemented in the form of coupling pins 118 which are arranged substantially side-by-side. It can be seen in FIG. 10 that the coupling means 118 are oriented in the x-direction, in the downhill position, and protrude from the binding body 116 in the direction of travel. In contrast, in FIG. 13 the coupling means 118 are twisted, in the release position, together with the binding body 116, about the release axis of rotation A, with respect to the base 112.

The Mz release mechanism comprises a spring arrangement having a spring means 130 which determines the predetermined release force. As can be seen for example in FIGS. 9 and 11, unlike in the first embodiment the spring means 130 can be a tension spring 130, which acts in particular without a cable element that is provided in addition.

Furthermore, the Mz release mechanism comprises a cam body 140 which is arranged on the binding body 116 and is designed, in the downhill position, to enter into link engagement with a mating contour 128 of a cam surface 126 provided on the base 112, in particular on the journal portion 124.

As can be seen in FIG. 12—a sectional view in a plane in parallel with the gliding board plane E along the lines D-D in FIG. 11, the spring arrangement is designed to exert a tractive force on the cam body 140 in order to draw it into link engagement with the mating contour 128 of the cam surface 126, and thereby to preload the heel unit 110 or the binding body 116 and the coupling means 118 into the downhill position.

For this purpose, a first spring end 134 of the tension spring 130 can be associated with the binding body 116, and a second spring end 136 of the tension spring 130 can be associated with the cam body 140, in order to transfer the tractive force to the cam body 140. For example, a shaft 132 can be fastened on the binding body 116, it being possible for the first spring end 134, for example in the form of a hook portion, to be suspended on the shaft 132. The second spring end 136 can be fastened to an adjustment screw 138 for example, by means of which a spring preload of the tension spring 130 can be adjustable and which is itself fastened on the cam body 140, in order to transfer the tractive force via the tension spring 130 and the adjustment screw 138 to the cam body 140.

The cam body 140 can in turn be pivotably arranged on the binding body 116. In the second embodiment, the cam body 140 can in particular be arranged on the binding body 116 so as to be pivotable about a swivel pin 142 which is in parallel with the release axis of rotation A.

The downhill position of the heel unit 110 is shown in FIGS. 9 to 12, while the release position of the heel unit 110 is shown in FIGS. 13 to 15. FIGS. 12 and 15 are sectional views in a plane in parallel with the gliding board plane E, at the height of the mating contour 128 of the cam surface 126, which is formed on the journal portion 124 of the base 112. FIG. 12 is a sectional view along the lines D-D in FIG. 11, and FIG. 15 is a sectional view along the lines E-E in FIG. 14.

An Mz release of the heel unit 110 according to the second embodiment of the present invention by means of the Mz release mechanism functions in a manner similar to that in the case of the first embodiment, with the difference that the tractive force or preload force is not transferred to the cam body 140 by a torsion spring in conjunction with a cable element, but rather by a tension spring 140.

In FIG. 12 the part of the cam body 140 protruding in the direction of the binding body 116 is preloaded into a recess on the journal portion 124, formed by the mating contour 128 on the cam surface 126, on account of the tractive force exerted on the cam body 140 via the tension spring 130. In comparison therewith, FIG. 15 in turn shows a state during or after an Mz release. In this state, a force that exceeds the Mz release force acts (or has acted) on the coupling means 118, in particular from a lateral direction, resulting in a torque about the Z-axis. It can be seen in FIG. 15 that the cam body 140 has moved along the mating contour 128 of the cam surface 126 due to the rotational movement of the binding body 116 on which it is mounted, and has been pushed backwards in the direction of travel due to a sliding movement along said link surface in conjunction with a rotational or pivot movement about the swivel pin 142, counter to the spring preload transferred by the tension spring 130. A rotation of the coupling means 118 and of the binding body 116 with respect to the base 112, about the release axis of rotation A counter to the spring force of the spring means 130, thus lead to an adjustment between the downhill position and release position.

A third embodiment of the present invention is described in the following with reference to FIGS. 16 to 24. In the description of the third embodiment too, only the differences with respect to the first embodiment are discussed in greater detail, while with respect to all the remaining features reference is made to the description of the first embodiment. Features and functions not described again in the third embodiment can be transferred in the same or in a corresponding manner from the first embodiment to the third embodiment. The explanations regarding the X-, Y- and Z-axis, and x-, y- and z-direction in the description of the first and of the second embodiment thus apply equally for the third embodiment of the present invention.

A heel unit 210 of the third embodiment, shown in a perspective view in FIG. 16, also comprises a base 212 for fastening the heel unit 210 on a gliding board (not shown). A fastening arrangement of the base 212, implemented for example by a fastening hole 214 for fastening screws, and a lower support surface of the base 212, again define a gliding board plane E corresponding to a surface of the gliding board on which the heel unit 210 is to be mounted. Furthermore, the heel unit 210 comprises a binding body 216 which is again rotatable relative to the base 212 about a release axis of rotation A extending orthogonally to the gliding board plane E. The base 112 can, as in the first and in the second embodiment, comprise a journal portion 224 (see FIGS. 19 and 23), about which the binding body 216 can rotate about the release axis of rotation A.

The heel unit 210 also comprises an Mz release mechanism which is designed to preload the coupling means 218 into the downhill position in such a way that, in the downhill position, they are freed from the engagement with the gliding board boot upon action of a force exceeding a predetermined release force, and move out of the downhill position and into the release position by means of a rotational movement of the binding body 216 about the release axis of rotation A. The coupling means 218 can, as in the two embodiments described above, be implemented in the form of coupling pins 218 which are arranged substantially side-by-side. It can be seen in FIG. 17 that the coupling means 218 are oriented in the x-direction, in the downhill position, and protrude from the binding body 216 in the direction of travel. In contrast, in the stage of the heel unit 210 shown in FIG. 21, the coupling means 218 are twisted, in the release position, together with the binding body 216, about the release axis of rotation A, with respect to the base 212.

Furthermore, the Mz release mechanism also again comprises a cam body 240 which is arranged on the binding body 216 and is designed, in the downhill position, to enter into link engagement with a mating contour 228 of a cam surface 226 provided on the base 212, in particular on the journal portion 224, as can be seen in FIG. 19.

The Mz release mechanism comprises a spring arrangement having a spring means 130 which determines the predetermined release force. As can be seen most clearly in FIGS. 20 and 24, in the case of the third embodiment the spring means 230 is a torsion spring 230, and the spring arrangement is designed to exert a spring force on the cam body 240, in order to bring it into link engagement with the mating contour 228 of the cam surface 226. The torsion spring 230 of the third embodiment can in particular act without a cable element that is provided in addition.

As can be seen in FIGS. 20 and 24, a first spring leg 234 of the torsion spring 230 can be supported on a portion of the binding body 216, and a second spring leg 236 of the torsion spring 230 can be supported on a portion of the Mz release mechanism, in particular on a portion of the cam body 240. As a result, the preload force of the torsion spring 230 can be transferred directly to the cam body 240, by the spring legs 234, 236.

As in the embodiments described above, the spring preload of the torsion spring 230 can be adjustable in particular by means of an adjustment screw 238, the arrangement of which is clear for example from FIGS. 18, 20 and 24. According thereto, the adjustment screw 238 can be fastened on a portion of the binding body 216, in particular can be in threaded engagement with the binding body, and can press against a spring leg 234 of the torsion spring 230 when the screw 238 is rotated in the thread direction, in order to increase the spring preload, or can reduce the pressure on a spring leg 234 of the torsion spring 230 when the screw 238 is rotated counter to the thread direction, in order to reduce the spring preload.

The cam body 240 can in turn be pivotably arranged on the binding body 216. In the third embodiment, the cam body 240 can in particular be arranged on the binding body 216 so as to be pivotable about a swivel pin 242 which is in parallel with the gliding board plane E and orthogonal to the release axis of rotation A.

The downhill position of the heel unit 210 is shown in FIGS. 16 to 20, while the release position of the heel unit 210 is shown in FIGS. 21 to 24. FIGS. 19 and 23 are sectional views in a plane in parallel with the gliding board plane E, at the height of the mating contour 228 of the cam surface 226, which is formed on the journal portion 224 of the base 212. FIG. 19 is a sectional view along the lines F-F in FIG. 18, and FIG. 23 is a sectional view along the lines G-G in FIG. 22.

An Mz release of the heel unit 210 according to the third embodiment of the present invention by means of the Mz release mechanism functions in a manner similar to that in the case of the first and second embodiment, with the difference that the preload force is transferred directly to the cam body 240 by a torsion spring.

In FIG. 19 the cam body 240 is preloaded into a recess on the journal portion 224, formed by the mating contour 228 on the cam surface 226, on account of the preload force exerted on the cam body 240 via the torsion spring 230. In comparison therewith, FIG. 23 shows a state during or after an Mz release. In this state, a force that exceeds the Mz release force acts (or has acted) on the coupling means 218, in particular from a lateral direction, resulting in a torque about the Z-axis. It can again be seen in FIG. 23 that the cam body 240 has moved along the mating contour 228 of the cam surface 226 due to the rotational movement of the binding body 216 on which it is mounted, and has been pushed backwards in the direction of travel due to a sliding movement along said link surface in conjunction with a rotational or pivot movement about the swivel pin 242, counter to the spring preload transferred by the torsion spring 230. A rotation of the coupling means 218 and of the binding body 216 with respect to the base 212, about the release axis of rotation A counter to the spring force of the torsion spring 230, thus lead to an adjustment between the downhill position and release position.

The invention claimed is:

1. A heel unit for a gliding board binding, comprising:

a base comprising a fastening arrangement for fastening to a gliding board;

a binding body, wherein the binding body is rotatable relative to the base about a release axis of rotation extending orthogonally to a gliding board plane;

coupling means arranged on the binding body, wherein the coupling means are configured to engage with a heel portion of a gliding board boot in a downhill position of the gliding board binding to securely hold the gliding board boot on the gliding board binding, the coupling means protruding in a gliding board longitudinal direction from the binding body in the downhill position of the gliding board binding; and an Mz release mechanism which is designed to preload the coupling means into the downhill position so that, in the downhill position, the coupling means are freed from the engagement with the gliding board boot upon action of a force exceeding a predetermined release force, and so that the coupling means move out of the downhill position and into a release position by means of a rotational movement of the binding body about the release axis of rotation, wherein the Mz release mechanism comprises a spring arrangement having a spring means that determines the predetermined release force and a cable element, wherein the Mz release mechanism comprises a cam body arranged on the binding body, wherein the cam body is configured in the downhill position, to enter link engagement with a mating contour of a cam surface provided on the base, wherein the spring arrangement is configured to exert a tractive force on the cam body to draw the cam body into link engagement with the mating contour of the cam surface, and wherein the cable element is configured to transfer the tractive force exerted by the spring arrangement onto the cam body.

2. The heel unit of claim 1, wherein a first end portion of the cable element is fastened to the spring means.

3. The heel unit of claim 2, wherein a second end portion of the cable element is fixed to the binding body, wherein the second end portion is different from the first end portion.

4. The heel unit of claim 1, wherein the binding body comprises at least one guide portion for the cable element.

5. The heel unit of claim 1, wherein the spring means comprises a torsion spring.

6. The heel unit of claim 5, wherein one or more of:

a first spring leg of the torsion spring is supported on a portion of the binding body, or a second spring leg of the torsion spring is supported on a first end portion of the cable element.

7. The heel unit of claim 1, wherein the gliding board binding comprises a touring binding.

8. The heel unit of claim 1, wherein the gliding board longitudinal direction is forwards in a direction of travel.

9. A heel unit for a gliding board binding, comprising:

a base comprising a fastening arrangement for fastening to a gliding board;

a binding body, wherein the binding body is rotatable relative to the base about a release axis of rotation extending orthogonally to a gliding board plane;

coupling means arranged on the binding body, wherein the coupling means are configured to engage with a heel portion of the gliding board boot in a downhill position of the gliding board binding to securely hold the gliding board boot on the gliding board binding, the coupling means protruding, in a gliding board longitudinal direction, from the binding body in the downhill position; and an Mz release mechanism configured to preload the coupling means into the downhill position such that, in the downhill position, the coupling means are freed from the engagement with the gliding board boot upon action of a force exceeding a predetermined release force, and such that the coupling means move out of the downhill position and into a release position by means of a rotational movement of the binding body about the release axis of rotation, wherein the Mz release mechanism comprises a spring arrangement, the spring arrangement comprising a spring means that determines the predetermined release force, wherein the Mz release mechanism comprises a cam body arranged on the binding body, wherein the cam body is configured, in the downhill position, to enter link engagement with a mating contour of a cam surface provided on the base, wherein the spring arrangement is configured to exert a spring force on the cam body to bring the cam body into link engagement with the mating contour of the cam surface, and wherein the spring means comprises a torsion spring.

10. The heel unit of claim 9, wherein one or more of:

a first spring leg of the torsion spring is supported on a portion of the binding body, or a second spring leg of the torsion spring is supported on a portion of the Mz release mechanism.

11. The heel unit of claim 10, wherein the portion of the Mz release mechanism comprises a portion of the cam body.

12. The heel unit of claim 9, wherein the cam body is arranged pivotably on the binding body.

13. The heel unit of claim 12, wherein the cam body is arranged on the binding body so as (A) to be pivotable about a swivel pin that is in parallel with the gliding board plane and orthogonal to the release axis of rotation, or (B) to be pivotable about a swivel pin that is parallel to the release axis of rotation.

14. The heel unit of claim 9, wherein a spring preload of the spring means is adjustable.

15. The heel unit of claim 14, wherein the spring preload is adjustable by means of an adjustment screw.

16. The heel unit of claim 9, wherein the coupling means comprise two coupling pins arranged substantially side-by-side and configured to engage in recesses of the heel portion of the gliding board boot to securely hold the gliding board boot on the gliding board binding, wherein at least one of the two coupling pins is movable relative to the other coupling pin.

17. A touring binding, comprising:

a heel unit comprising:

a base comprising a fastening arrangement for fastening to a gliding board;

a binding body, wherein the binding body is rotatable relative to the base about a release axis of rotation extending orthogonally to a gliding board plane;

coupling means arranged on the binding body, wherein the coupling means are configured to engage with a heel portion of a gliding board boot in a downhill position of the gliding board binding to securely hold the gliding board boot on the gliding board binding, the coupling means protruding in a gliding board longitudinal direction from the binding body in the downhill position of the gliding board binding; and an Mz release mechanism which is designed to preload the coupling means into the downhill position so that, in the downhill position, the coupling means are freed from the engagement with the gliding board boot upon action of a force exceeding a predetermined release force, and so that the coupling means move out of the downhill position and into a release position by means of a rotational movement of the binding body about the release axis of rotation, wherein the Mz release mechanism comprises a spring arrangement and a cable element, wherein the Mz release mechanism comprises a cam body arranged on the binding body, wherein the cam body is configured, in the downhill position, to enter link engagement with a mating contour of a cam surface provided on the base, wherein the spring arrangement is configured to exert a tractive force on the cam body to draw the cam body into link engagement with the mating contour of the cam surface, and wherein the cable element is configured to transfer the tractive force exerted by the spring arrangement onto the cam body.

* * * * *